US010423084B2

(12) United States Patent
Aichi et al.

(10) Patent No.: US 10,423,084 B2
(45) Date of Patent: Sep. 24, 2019

(54) METHOD FOR PRODUCING LIQUID DEVELOPER

(71) Applicant: CANON KABUSHIKI KAISHA, Tokyo (JP)

(72) Inventors: Yasuhiro Aichi, Tokyo (JP); Junji Ito, Hiratsuka (JP); Jun Shirakawa, Kawaguchi (JP); Waka Hasegawa, Tokyo (JP); Ryo Natori, Tokyo (JP); Ayano Mashida, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/190,237

(22) Filed: Nov. 14, 2018

(65) Prior Publication Data

US 2019/0155180 A1 May 23, 2019

(30) Foreign Application Priority Data

Nov. 20, 2017 (JP) ..... 2017-222664
Jul. 6, 2018 (JP) ..... 2018-129132

(51) Int. Cl.
*G03G 9/08* (2006.01)
*G03G 9/125* (2006.01)
*G03G 9/13* (2006.01)

(52) U.S. Cl.
CPC ..... *G03G 9/0804* (2013.01); *G03G 9/125* (2013.01); *G03G 9/132* (2013.01)

(58) Field of Classification Search
CPC ..... G03G 9/0804; G03G 9/125; G03G 9/132
USPC ..... 430/114, 137.22
See application file for complete search history.

(56) References Cited

U.S. PATENT DOCUMENTS

| | | | |
|---|---|---|---|
| 5,760,257 | A | 6/1998 | Tanaka et al. |
| 7,833,687 | B2 | 11/2010 | Kato et al. |
| 8,399,170 | B2 | 3/2013 | Iwase et al. |
| 8,697,327 | B2 | 4/2014 | Shibata et al. |
| 8,722,302 | B2 | 5/2014 | Maeda et al. |
| 8,815,484 | B2 | 8/2014 | Tanaka et al. |
| 9,057,970 | B2 | 6/2015 | Ida et al. |
| 9,229,345 | B2 | 1/2016 | Ikeda et al. |

(Continued)

FOREIGN PATENT DOCUMENTS

| | | |
|---|---|---|
| CA | 2 609 825 | 11/2006 |
| JP | 2003-241439 | 8/2003 |

(Continued)

OTHER PUBLICATIONS

U.S. Appl. No. 16/140,615, Waka Hasegawa, filed Sep. 25, 2018.

*Primary Examiner* — Mark A Chapman
(74) *Attorney, Agent, or Firm* — Venable LLP

(57) ABSTRACT

A method for producing a liquid developer, the method including a step of producing a toner particle by applying a shear force to a mixture of a polyester resin A and B, and a toner particle dispersing agent in a liquid a, wherein the polyester resin A has a number-average molecular weight from 3,000 to 7,000, an acid value of at least 5, and a carboxy group; the polyester resin B has a number-average molecular weight from 4,000 to 20,000 and an acid value of not more than 2; the toner particle dispersing agent has a primary amino group and an amine value of at least 40; the mass ratio (B/(A+B)) for the polyester resin B is 0.3 to 0.9; and the following relationship is satisfied: SP value of liquid a<SP value of the toner particle dispersing agent<SP value of polyester resin B.

11 Claims, 2 Drawing Sheets

(56) References Cited

U.S. PATENT DOCUMENTS

| | | | |
|---|---|---|---|
| 9,348,247 | B2 | 5/2016 | Ida et al. |
| 9,556,290 | B2 | 1/2017 | Nishiura et al. |
| 9,715,187 | B2 | 7/2017 | Mukumoto et al. |
| 9,740,118 | B2 | 8/2017 | Hasegawa et al. |
| 9,766,568 | B2 | 9/2017 | Ito et al. |
| 9,857,716 | B2 | 1/2018 | Natori et al. |
| 9,880,482 | B2 | 1/2018 | Hasegawa et al. |
| 9,891,546 | B2 | 2/2018 | Ito et al. |
| 9,891,547 | B2 | 2/2018 | Tanabe et al. |
| 9,897,936 | B2 | 2/2018 | Natori et al. |
| 9,971,268 | B2 | 5/2018 | Tanabe et al. |
| 2010/0136474 | A1 | 6/2010 | Iwase et al. |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2017/0102628 | A1 | 4/2017 | Kabashima et al. |
| 2018/0046105 | A1 | 2/2018 | Tanabe et al. |
| 2018/0046106 | A1 | 2/2018 | Shirakawa et al. |
| 2018/0059566 | A1 | 3/2018 | Tanabe et al. |
| 2018/0143546 | A1 | 5/2018 | Hasegawa et al. |
| 2018/0329333 | A1 | 11/2018 | Tokunaga et al. |
| 2018/0348658 | A1 | 12/2018 | Tsuchida et al. |

FOREIGN PATENT DOCUMENTS

| | | |
|---|---|---|
| JP | 3718915 | 11/2005 |
| JP | 2014-232211 | 12/2014 |
| JP | 2016-224405 | 12/2016 |
| WO | 2006/126566 | 11/2006 |
| WO | 2007/000974 | 1/2007 |
| WO | 2007/000975 | 1/2007 |
| WO | 2007/108485 | 9/2007 |
| WO | 2009/041634 | 4/2009 |

METHOD FOR PRODUCING LIQUID DEVELOPER

BACKGROUND OF THE INVENTION

Field of the Invention

The present invention relates to the liquid developer that is used in image-forming apparatuses that employ an electrophotographic system, e.g., electrophotography, electrostatic recording, electrostatic printing, and so forth.

Description of the Related Art

Plate-based presses have in the past been used to produce printed materials for which a certain number of copies are required, such as regional advertising, internally distributed business documents, and large posters.

In place of these conventional presses, on-demand printers have entered into use in recent years; these on-demand printers can rapidly respond to a diversifying range of needs and support inventory reductions. Electrophotographic printers that use liquid developers and inkjet printers capable of high speeds and high quality printing are anticipated for such on-demand printers.

Liquid developers use an electrically insulating liquid as a carrier liquid and because of this are more resistant than dry developers to the problem of aggregation of the toner particles in the liquid developer during storage, and thus enable the use of microfine toner particles. As a result, liquid developers provide a better fine line image reproducibility and a better gradation reproducibility than dry developers and exhibit an excellent color reproducibility and also excellence in high-speed image-forming methods. Development is becoming quite active with regard to high-image-quality, high-speed digital printing apparatuses that exploit these excellent characteristics by using liquid developers. In view of these circumstances, there is demand for the development of liquid developers that have even better properties.

Photocurable liquid developers are known within the sphere of liquid developers. A photocurable liquid developer uses a reactive functional group-bearing monomer or oligomer as the electrical insulating liquid and can be prepared by the addition and dissolution of a photopolymerization initiator. This photocurable liquid developer is cured by a polymerization reaction when exposed to light, e.g., ultraviolet radiation, and can accommodate high-speed development processing.

A method is already known, for example, as in Japanese Patent Application Laid-open No. 2016-224405, for producing a microfine toner particle using the combination of a resin B having an acid value and a resin A bearing an alkali metal sulfonate salt group or an alkaline-earth metal sulfonate salt group.

With regard to methods for producing a liquid developer that exhibits an excellent toner particle dispersion stability and excellent charging characteristics on the part of the liquid developer, a method is known, as in WO 09/041634, for producing a toner particle by a coacervation technique in the presence of a special toner particle dispersing agent and a resin having an acid value.

The liquid developers produced using these methods do have excellent initial characteristics as developers. However, when the residual undeveloped toner particles and the residual untransferred toner particles at, e.g., the developing roller and photosensitive member, are recovered using a cleaning blade, and when recovery continues for a certain amount of time, the recovered toner particles can aggregate and aggregates can then end up being produced.

In order to inhibit this toner particle aggregation, an art is disclosed in Japanese Patent Application Laid-open No. 2014-232211 wherein core particles and shell particles are separately prepared; a toner particle is then prepared by attaching the shell particles to the circumference of the core particle; and a basic dispersing agent is also added.

SUMMARY OF THE INVENTION

A microfine toner particle can be produced when a toner particle dispersing agent is used during toner particle production; however, when the toner particle dispersing agent is not tightly bonded to the toner particle surface, aggregates may be produced when shear force is input from, for example, the cleaning blade. Moreover, when a basic toner particle dispersing agent is added post-toner particle production, the basic toner particle dispersing agent can separate from the toner particle and the resistance of the insulating liquid carrier may then be reduced.

By bringing about an efficient orientation and tight bonding of the basic toner particle dispersing agent to the toner particle surface, the present invention provides a method for producing a liquid developer that is resistant to reductions in the volume resistivity of the insulating liquid carrier, that can resist the production of aggregates even when shear force is applied to the toner particle by, e.g., the cleaning blade, and that exhibits an excellent toner particle dispersion stability.

The present invention is a method for producing a liquid developer containing an insulating liquid carrier, a toner particle dispersing agent, and a toner particle that contains a polyester resin A and a polyester resin B, the method including the following process A or process B: the process A having a step of particulating a mixture of the polyester resin A, the polyester resin B, and the toner particle dispersing agent in a liquid a by applying a shear force to the mixture, and a step of producing a toner particle in the liquid a via a molten state; and the process B having a step of dissolving, in a solvent b, a mixture of the polyester resin A, the polyester resin B, and the toner particle dispersing agent, a step of mixing the resulting solution with the liquid a and applying shear force to particulate the mixture in the liquid a and provide a toner particle, and a step of distillatively removing the solvent b, wherein the liquid a dissolves the toner particle dispersing agent and does not dissolve the polyester resin A and does not dissolve the polyester resin B, the polyester resin A has a number-average molecular weight from 3,000 to 7,000, the polyester resin A has an acid value of at least 5 mg KOH/g, the polyester resin A has, as an acidic group, a carboxy group deriving from trimellitic acid and/or trimellitic anhydride, the polyester resin B has a number-average molecular weight from 4,000 to 20,000, the polyester resin B has an acid value of not more than 2 mg KOH/g, the toner particle dispersing agent has a primary amino group, the toner particle dispersing agent has an amine value of at least 40 mg KOH/g, a mass ratio (B/(A+B)) of the polyester resin B to a sum of the polyester resin A and the polyester resin B is from 0.3 to 0.9, and an SP value of the liquid a, an SP value of the polyester resin B, and an SP value of the toner particle dispersing agent satisfy the following relationship: SP value of liquid a<SP value of toner particle dispersing agent<SP value of polyester resin B.

Thus, by bringing about an efficient orientation and tight bonding of the basic toner particle dispersing agent to the toner particle surface, the present invention provides a method for producing a liquid developer that is resistant to reductions in the volume resistivity of the insulating liquid carrier, that can resist the production of aggregates even when shear force is applied to the toner particle by, e.g., the cleaning blade, and that exhibits an excellent toner particle dispersion stability.

Further features of the present invention will become apparent from the following description of exemplary embodiments with reference to the attached drawings.

DESCRIPTION OF THE EMBODIMENTS

Figure 1:
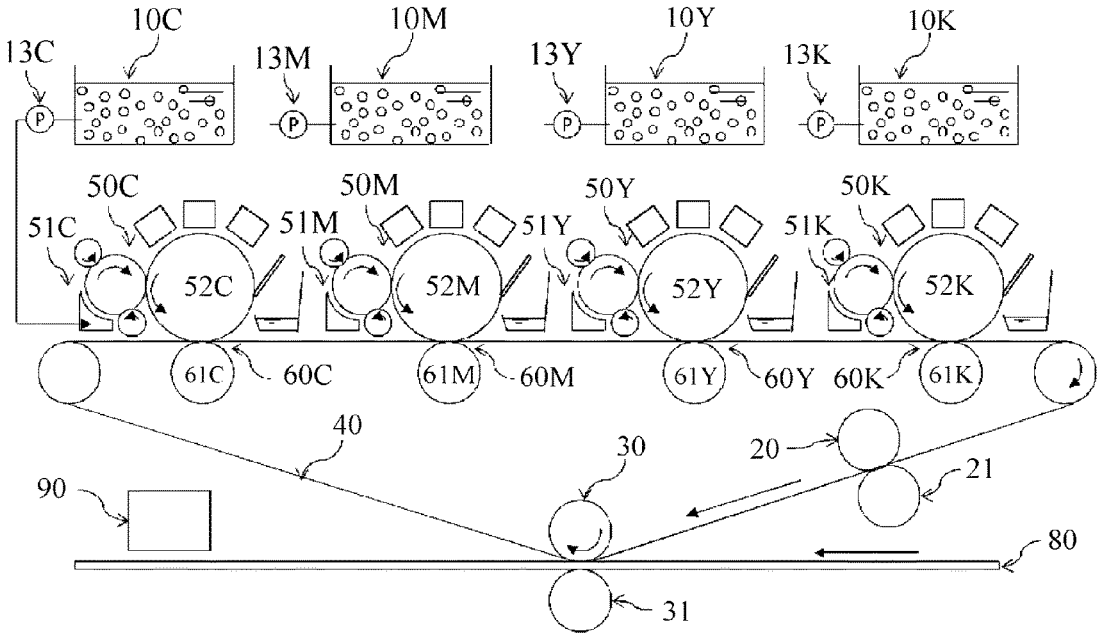
FIG. 1 is a schematic diagram of a developing apparatus.

The present invention is a method for producing a liquid developer containing an insulating liquid carrier, a toner particle dispersing agent, and a toner particle that contains a polyester resin A and a polyester resin B, the method including the following process A or process B: the process A having a step of particulating a mixture of the polyester resin A, the polyester resin B, and the toner particle dispersing agent in a liquid a by applying a shear force to the mixture, and a step of producing a toner particle in the liquid a via a molten state; and the process B having a step of dissolving, in a solvent b, a mixture of the polyester resin A, the polyester resin B, and the toner particle dispersing agent, a step of mixing the resulting solution with the liquid a and applying shear force to particulate the mixture in the liquid a and provide a toner particle, and a step of distillatively removing the solvent b, wherein the liquid a dissolves the toner particle dispersing agent and does not dissolve the polyester resin A and does not dissolve the polyester resin B, the polyester resin A has a number-average molecular weight from 3,000 to 7,000, the polyester resin A has an acid value of at least 5 mg KOH/g, the polyester resin A has, as an acidic group, a carboxy group deriving from trimellitic acid and/or trimellitic anhydride, the polyester resin B has a number-average molecular weight from 4,000 to 20,000, the polyester resin B has an acid value of not more than 2 mg KOH/g, the toner particle dispersing agent has a primary amino group, the toner particle dispersing agent has an amine value of at least 40 mg KOH/g, a mass ratio (B/(A+B)) of the polyester resin B to a sum of the polyester resin A and the polyester resin B is from 0.3 to 0.9, and an SP value of the liquid a, an SP value of the polyester resin B, and an SP value of the toner particle dispersing agent satisfy the following relationship: SP value of liquid a<SP value of toner particle dispersing agent<SP value of polyester resin B.

Unless specifically indicated otherwise, the expressions "from XX to YY" and "XX to YY" that show numerical value ranges refer in the present invention to numerical value ranges that include the lower limit and upper limit that are the end points.

Materials

The materials used in and by the present invention are described in detail herebelow.

Liquid a

The toner particle is produced in a liquid a in the production method according to the present invention.

The liquid a satisfies the following relationship for the SP value of the liquid a, the SP value of the polyester resin B, and the SP value of the toner particle dispersing agent: SP value of liquid a<SP value of toner particle dispersing agent<SP value of polyester resin B.

In addition, the liquid a dissolves the toner particle dispersing agent and does not dissolve the polyester resin A and B. Otherwise, the liquid a may be any medium that can transmit the shear force applied in the process A to the mixture of polyester resin A+polyester resin B+toner particle dispersing agent.

The criterion for "the liquid a does not dissolve a polyester resin" is that not more than 1 mass parts of the polyester resin dissolves in 100 mass parts of the liquid a at a temperature of 25° C. The criterion for "the liquid a dissolves the toner particle dispersing agent" is that at least 10 mass parts of the toner particle dispersing agent dissolves in 100 mass parts of the liquid a at a temperature of 25° C. Preferably the liquid a does not dissolve the toner particle. The criterion for "the liquid a does not dissolve the toner particle" is that not more than 1 mass parts of the toner particle dissolves in 100 mass parts of the liquid a at a temperature of 25° C.

Considering the general range of SP values for polyester resins and toner particle dispersing agents, an organic solvent having a low SP value is preferably used for the liquid a.

The liquid a can be exemplified by hydrocarbon solvents such as hexane, octane, isooctane, decane, isodecane, decalin, nonane, dodecane, and isododecane; paraffin solvents such as Isopar E, Isopar G, Isopar H, Isopar L, Isopar M, and Isopar V (ExxonMobil), Shellsol A100 and Shellsol A150 (Shell Chemicals Japan Ltd.), and Moresco White MT-30P (Matsumura Oil Co., Ltd.); and substituent-bearing hydrocarbons. For example, hexane and Moresco White MT-30P are preferred. A single one or a mixture of these can be used.

The liquid a preferably contains a cationically polymerizable liquid monomer. Specific examples here are cyclic ether monomers such as epoxides and oxetanes and vinyl ether compounds.

This vinyl ether compound refers to a compound having the vinyl ether structure (—CH═CH—O—C—).

Specific examples are dodecyl vinyl ether, dicyclopentadiene vinyl ether, cyclohexanedimethanol divinyl ether, tricyclodecane vinyl ether, dipropylene glycol divinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether, and 1,2-decanediol divinyl ether.

After the toner particle has been produced, the liquid a as such may be used as the carrier liquid for the liquid developer, or it may be replaced, e.g., by decantation or filtration, by an insulating liquid carrier suitable for liquid developers. The liquid a as such is preferably used as the carrier liquid for the liquid developer after the toner particle has been produced. That is, the liquid a is preferably an insulating liquid carrier.

Toner Particle

From the standpoint of obtaining a high-definition image, the toner particle has a 50% particle diameter on a volume basis (D50) preferably from 0.05 μm to 2.0 μm, more preferably from 0.05 μm to 1.2 μm, and still more preferably from 0.05 μm to 1.0 μm.

When the 50% particle diameter on a volume basis (D50) of the toner particle is in the indicated range, the resolution and image density of the toner image formed by the liquid developer can be brought to satisfactorily high levels, and at the same time the film thickness of the toner image can be made satisfactorily thin.

An example of the process A in the toner particle production method is the execution of a heating/stirring method subsequent to a method such as a known wet pulverization procedure. The details of the wet pulverization procedure are described in, for example, WO 2006/126566 and WO 2007/108485. The heating/stirring method may be any such method that provides—via a molten state wherein the molecules constituting the particles yielded by pulverization can move freely—an energetically stable state, and that can provide stirring to a degree that prevents sedimentation and aggregation of the molten particles.

The toner particle concentration in the liquid developer may be brought to from about 1 mass % to 50 mass % and is preferably from 2 mass % to 40 mass %.

The process B in the toner particle production method can be exemplified by known methods, for example, the coacervation method. The details of the coacervation method are described in, for example, Japanese Patent Application Laid-open No. 2003-241439, WO 2007/000974, and WO 2007/000975. Known methods such as these may be used in the present invention.

The toner particle concentration in the liquid developer may be brought to from about 1 mass % to 50 mass % and is preferably from 2 mass % to 40 mass %.

The toner particle contains a polyester resin A and a polyester resin B.

Polyester Resin

Polyester resin A and polyester resin B are used as binder resins for the toner particle. To the extent that the effects of the present invention are not impaired, a resin known for use as a binder resin may be used in addition to polyester resin A and polyester resin B.

The polyester resin is preferably provided by the condensation polymerization of an alcohol monomer and a carboxylic acid monomer.

The alcohol monomer can be exemplified by the following: alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, as well as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, glycerol, sorbitol, 1,2,3,6-hexanetetrol, 1,4-sorbitan, pentaerythritol, dipentaerythritol, tripentaerythritol, 1,2,4-butanetriol, 1,2,5-pentanetriol, 2-methylpropanetriol, 2-methyl-1,2,4-butanetriol, trimethylolethane, trimethylolpropane, and 1,3,5-trihydroxymethylbenzene.

The carboxylic acid monomer, on the other hand, can be exemplified by the following:

aromatic dicarboxylic acids such as phthalic acid, isophthalic acid, and terephthalic acid and their anhydrides; alkyl dicarboxylic acids such as succinic acid, adipic acid, sebacic acid, and azelaic acid and their anhydrides; succinic acid substituted by an alkyl group having 6 to 18 carbons or by an alkenyl group having 6 to 18 carbons, and anhydrides thereof; and unsaturated dicarboxylic acids such as fumaric acid, maleic acid, and citraconic acid and their anhydrides.

The following monomers can be used in addition to the preceding: polyhydric alcohols such as the oxyalkylene ethers of novolac-type phenolic resins; and polybasic carboxylic acids such as trimellitic acid, pyromellitic acid, benzophenonetetracarboxylic acid, and their anhydrides.

Among the preceding, preferably either the carboxylic acid monomer or the alcohol monomer contains an aromatic ring. The presence of the aromatic ring causes a reduction in the crystallinity of the polyester resin and can thereby improve the solubility in solvent.

Among the preceding, the at least two species of polyester resin A and polyester resin B are used in the following ratio.

The mass ratio (B/(A+B)) of the polyester resin B to the sum of the polyester resin A and the polyester resin B must be from 0.3 to 0.9. From 0.4 to 0.8 is preferred.

Polyester Resin A

By selecting a polyester resin A as described in the following, a toner can be produced in which the toner particle dispersing agent is tightly bonded to the toner particle.

The number-average molecular weight of the polyester resin A is from 3,000 to 7,000 and is more preferably from 4,000 to 7,000. The polyester resin A is used in order to strongly adsorptively interact with the toner particle dispersing agent. The elution of the toner particle dispersing agent into the insulating liquid carrier can be inhibited when the number-average molecular weight is at least 3,000, while control of the particle diameter of the toner particle is facilitated when the number-average molecular weight is not more than 7,000.

The polyester resin A has an acid value of at least 5 mg KOH/g and contains, as an acidic group, a carboxy group derived from trimellitic acid or trimellitic anhydride.

It was found that a carboxy group derived from trimellitic acid or trimellitic anhydride exhibits a strong adsorptive interaction with the primary amino group present in the toner particle dispersing agent. It is therefore thought that the production of a toner particle in which the toner particle dispersing agent is tightly bonded to the polyester resin A present in the toner particle is made possible when such a carboxy group is present and the acid value is at least 5 mg KOH/g.

This carboxy group is preferably present in terminal position (more preferably in main chain terminal position) on the polyester resin A. The presence in terminal position enables bonding to occur with the amino group in the toner particle dispersing agent under conditions of low steric hindrance, thus enabling a multipoint adsorption and further raising the inhibitory effect on toner particle aggregation. The acid value is preferably at least 5 mg KOH/g and is more preferably at least 10 mg KOH/g. The upper limit, on the other hand, is not particularly limited, but is generally not more than 30 mg KOH/g and is preferably not more than 25 mg KOH/g.

Polyester Resin B

The polyester resin B is incorporated in the toner particle; preferably substantially does not interact with the toner particle dispersing agent described below; and is selected to have an SP value higher than the SP values of the liquid a and the toner particle dispersing agent. Thus, the following is satisfied: SP value of liquid a<SP value of toner particle dispersing agent<SP value of polyester resin B. This facilitates the entry of the polyester resin B into the interior of the toner particle. It is thought that, as a result, orientation of the toner particle dispersing agent and the polyester resin A, while residing in a state of adsorptive interaction, to the toner particle surface is facilitated and a toner exhibiting an excellent dispersion stability can be produced.

The following is preferably satisfied: SP value of liquid a+2.0<SP value of toner particle dispersing agent<SP value of polyester resin B−0.5.

The number-average molecular weight of the polyester resin B is from 4,000 to 20,000 and is preferably from 7,000 to 20,000. Elution into the insulating liquid carrier can be suppressed by having the number-average molecular weight of polyester resin B be at least 4,000, while control of the particle diameter of the toner particle is facilitated by having the number-average molecular weight be not more than 20,000.

The polyester resin B has an acid value of not more than 2 mg KOH/g. An acid value of not more than 2 mg KOH/g serves to restrain the inhibition of bond formation between the polyester resin A and the toner particle dispersing agent and is thus preferred. While the lower limit is not particularly limited, it is preferably equal to or greater than 0 mg KOH/g.

The polyester resin B preferably has a sulfo group that has formed a salt with at least one element selected from the group consisting of alkali metals and alkaline-earth metals. In the case of a salt with an alkali metal, this group is represented by $—SO_3R_a$ ($R_a$ is an alkali metal element); in the case of a salt with an alkaline-earth metal, this group is represented by $=(SO_3)R_b$ ($R_b$ is an alkaline-earth metal element). This group is more preferably a salt with an alkali metal and is still more preferably the sodium salt ($—SO_3Na$). The presence of such a sulfo group can bring about stabilization of the polarization of the charge of the moiety where the primary amino group in the toner particle dispersing agent engages in strong adsorptive interaction with the carboxy group in the polyester resin A deriving from trimellitic acid and/or trimellitic anhydride. It is thought that as a consequence the toner particle can more tightly bond with the toner particle dispersing agent and a better aggregation-inhibiting effect is then be obtained.

For example, the synthesis of polyester resin using monomer bearing such a sulfo group can then introduce, into the polyester resin B, a sulfo group formed into a salt with at least one element selected from the group consisting of alkali metals and alkaline-earth metals. An example of the method for this is the use of monosodium 5-sulfoisophthalate or a derivative thereof for the dicarboxylic acid monomer.

From 0.2 mass % to 2.0 mass % is preferred for the content, in the total monomer unit constituting the polyester resin B, of monomer unit deriving from monomer having a sulfo group that has formed a salt with at least one element selected from the group consisting of alkali metals and alkaline-earth metals. Here, "monomer unit" refers to the reacted form of the monomer substance in the polymer.

The mass ratio (B/(A+B)) of the polyester resin B to the sum of the polyester resin B and the polyester resin A is from 0.3 to 0.9 and is preferably from 0.4 to 0.8.

The following is thought to occur when this mass ratio is in the indicated range: the polyester resin B then enters the interior of the toner in the requisite amount and formation of the bonded species of the toner particle dispersing agent bonded to the toner particle surface is facilitated; due, in combination with this, to the strong adsorption of the toner particle dispersing agent to the toner particle under the effect of the polyester resin A, reductions in the resistance of the insulating liquid carrier are then suppressed and the particle aggregation-inhibiting effect of the present invention is also obtained.

Toner Particle Dispersing Agent

A toner particle dispersing agent bearing a primary amino group is used in the method according to the present invention for producing a liquid developer. This primary amino group denotes a group represented by $—NH_2$. A liquid developer that exhibits a high dispersion stability can be provided through the use of such a toner particle dispersing agent.

With the goal of causing the appearance of an adequate repulsive force in the carrier liquid, a toner particle dispersing agent may be provided with a substituent for raising the solubility in the carrier liquid. This functions to improve the dispersion stability of the toner particle. On the other hand, a toner particle dispersing agent bearing a primary amino group readily bonds with the polyester resin A. As a consequence, release of the toner particle dispersing agent into the carrier in the absence of adsorption to the toner particle can be suppressed and an excellent dispersion stability is provided and reductions in the resistivity of the liquid developer can be inhibited.

The primary amino group-bearing toner particle dispersing agent is preferably a primary amino group-bearing polymer, and a polyallylamine derivative is preferred. The primary amino group-bearing polymer preferably is not a polymer that has the primary amino group only in terminal position on the polymer main chain. However, it may have the primary amino group in terminal position as long as it has the primary amino group in a position other than terminal position on the polymer main chain.

In addition, it was found that the bond strength between a polyester resin A having the specified acid value and a polymer bearing a primary amino group in a position other than terminal position on the polymer main chain, is significantly stronger than for a polymer bearing a primary amino group only in terminal position on the polymer main chain and for a polymer bearing a secondary or tertiary amino group.

The primary amino group-bearing polymer preferably is a polymer that contains the monomer unit represented by the following formula (1) and the monomer unit represented by the following formula (2). In addition, this primary amino group-bearing polymer has the monomer unit represented by formula (1) in a position other than terminal position on the main chain. That is, polymer having the primary amino group only in terminal position on the polymer main chain is not included. However, the monomer unit with formula (1) may be present in terminal position on the polymer main chain as long as the monomer unit with formula (1) is present at a position other than terminal position on the main chain.

In addition, the amine value deriving from the primary amino group present in the monomer unit represented by formula (1) is preferably at least 50% of the amine value of the primary amino group-bearing polymer.

$$\text{-}(K)\text{-} \quad (1)$$

$$\text{-}(Q)\text{-} \quad (2)$$

[In formula (1), K represents a monomer unit having a primary amino group.]

[In formula (2), Q represents a monomer unit that has a possibly substituted alkyl group having at least 6 carbons, a possibly substituted cycloalkyl group having at least 6 carbons, a possibly substituted alkylene group having at least 6 carbons, or a possibly substituted cycloalkylene group having at least 6 carbons.]

The possibly substituted alkyl group having at least 6 carbons and the possibly substituted cycloalkyl group having at least 6 carbons encompassed by Q in formula (2) are represented, respectively, by the straight-chain $—C_nH_{2n+1}$ and the cyclic $—C_nH_{2n-1}$ and denote alkyl groups and cycloalkyl groups in which the number of carbons n is at least 6. In addition, the possibly substituted alkylene group having at least 6 carbons and the possibly substituted cycloalkylene group having at least 6 carbons are represented, respectively, by the straight-chain $—C_nH_{2n}—$ and the cyclic $—C_nH_{2n-2}—$ and denote alkylene groups and cycloalkylene groups in which the number of carbons n is at least 6.

The number of carbons n is more preferably at least 12 when viewed from the standpoint of the affinity with the carrier liquid. The upper limit on the number of carbons n is preferably not more than 30 and is more preferably not more than 22. At least one hydrogen atom in the alkyl group, cycloalkyl group, alkylene group, or cycloalkylene group may be substituted.

The substituent that may be present on the alkyl group, cycloalkyl group, alkylene group, or cycloalkylene group encompassed by Q is not particularly limited and can be exemplified by alkyl groups, alkoxy groups, halogen atoms, the amino group, the hydroxy group, the carboxy group, carboxylate ester groups, and carboxamide groups.

The monomer unit represented by formula (1) is more preferably the monomer unit represented by the following formula (3).

(3)

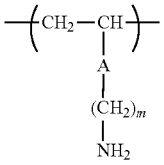

[In formula (3), A represents a single bond, an alkylene group having 1 to 6 carbons (preferably 1 to 3 carbons), or phenylene, and m represents an integer from 0 to 3.]

The monomer unit represented by formula (1) is still more preferably the monomer unit represented by the following formula (4).

(4)

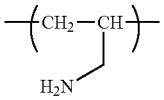

On the other hand, the monomer unit represented by formula (2) is more preferably the monomer unit represented by the following formula (5).

(5)

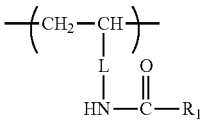

[In formula (5), $R_1$ represents a possibly substituted alkyl group having at least 6 carbons or a possibly substituted cycloalkyl group having at least 6 carbons, and L represents a divalent linker group.]

$R_1$ is represented by the straight-chain $—C_nH_{2n+1}$ or cyclic $—C_nH_{2n-1}$ and denotes an alkyl group or cycloalkyl group in which n is at least 6.

n is more preferably at least 12. The upper limit for n, on the other hand, is preferably not more than 30 and is more preferably not more than 22.

In addition, the substituent that may be present on $R_1$ is not particularly limited and can be exemplified by alkyl groups, alkoxy groups, halogen atoms, the amino group, the hydroxy group, the carboxy group, carboxylate ester groups, and carboxamide groups.

L represents a divalent linker group and is preferably an alkylene group having 1 to 6 carbons (more preferably an alkylene group having 1 to 3 carbons), an alkenylene group having 1 to 6 carbons (more preferably an alkenylene group having 1 to 3 carbons), or an arylene group having 6 to 10 carbons.

In another more preferred embodiment, the monomer unit represented by formula (2) is the monomer unit represented by the following formula (6).

(6)

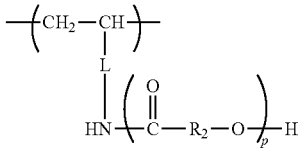

The $R_2$ in formula (6) is a possibly substituted alkylene group having at least 6 carbons or a possibly substituted cycloalkylene group having at least 6 carbons. p represents an integer with a value of at least 1 (preferably from 2 to 20). L represents a divalent linker group.

$R_2$ is represented by the straight-chain $—C_nH_{2n}—$ or cyclic $—C_nH_{2n-2}—$ and denotes an alkylene group or cycloalkylene group having at least 6 carbons. The number of carbons in the alkylene group or cycloalkylene group is more preferably at least 12. The upper limit for the number of carbons, on the other hand, is preferably not more than 30 and is more preferably not more than 22.

In addition, the substituent that may be present on $R_2$ is not particularly limited and can be exemplified by alkyl groups, alkoxy groups, halogen atoms, the amino group, the hydroxyl group, the carboxyl group, carboxylate ester groups, and carboxamide groups.

Preferred examples for L are the same as for formula (5).

The monomer unit represented by formula (1) may be a combination of any such monomer units, and the monomer unit represented by formula (2) may be a combination of any such monomer units.

The primary amino group-bearing polymer is preferably a polyallylamine derivative that contains the monomer unit represented by formula (4) in the polymer.

The number of monomer units represented by formula (4) present in each molecule of this polyallylamine derivative is preferably, as an average, from 10 to 200, more preferably from 20 to 150, and still more preferably from 50 to 150.

In addition, this primary amino group-bearing polymer is more preferably a polyallylamine derivative that contains, in one and the same polymer, the monomer unit represented by formula (4) and the monomer unit represented by formula (6).

The molar ratio between the monomer unit with formula (4) and the monomer unit with formula (6) [monomer unit with formula (4): monomer unit with formula (6)] in this polymer is preferably 10:90 to 90:10 and is more preferably 50:50 to 80:20.

The polyallylamine derivative is also more preferably a polyallylamine derivative as provided by the reaction of a polyallylamine with the self-condensate of 12-hydroxystearic acid. Such a polyallylamine derivative can be synthesized by the method disclosed in, for example, Japanese Patent No. 3,718,915.

In addition, a commercially available polyamine compound and polyamine compound solution may be used to produce this polyallylamine derivative. Examples here are PAA-01, PAA-1LV, PAA-03, PAA-05, PAA-08, PAA-15, PAA-15C, PAA-25, and PAA-03E (Nittobo Medical Co., Ltd).

The amine value of the toner particle dispersing agent is at least 40 mg KOH/g. When the amine value is made at least 40 mg KOH/g, adsorption with the acid groups of the polyester resin A present at the toner particle surface can occur at multiple points, which supports strong retention by the toner particle and increases the dispersion stability.

The amine value is preferably at least 60 mg KOH/g. When the amine value is made at least 60 mg KOH/g, adsorption with the acid groups of the polyester resin A present at the toner particle surface can be realized at even more points, which supports an even greater increase in the dispersion stability.

The upper limit on the amine value is not particularly limited, but is generally not more than 300 mg KOH/g and is preferably not more than 200 mg KOH/g.

Moreover, it was found that a liquid developer having a high dispersion stability can be produced by having the SP value of the polyester resin B and the SP value of the liquid a satisfy the following formula (7).

$$SP_{career} < \left(\frac{E_d + a \times n \times E_p}{(V_d + a \times n \times V_p}\right)^{0.5} < SP_{PESB} \quad (7)$$

[In formula (7), Ed and Ep respectively represent the cohesive energy of the toner particle dispersing agent and the polyester resin A, and Vd and Vp respectively represent the molar volume of the toner particle dispersing agent and the polyester resin A. Also, a represents the number-average number of amino groups per molecule with respect to the average degree of polymerization of the toner particle dispersing agent, and n represents the number-average degree of polymerization of the polyester resin A. $SP_{Career}$ represents the SP value of the liquid a, and $SP_{PESB}$ represents the SP value of the polyester resin B.]

The SP value is the solubility parameter. The SP value is a value introduced by Hildebrand and defined by a formal theory, and it is given by the square root of the cohesive energy density of the solvent (or solute) and is a measure of the solubility in a two-component system solution.

The SP value, cohesive energy, and molar volume of the liquid a, polyester resin A, polyester resin B, and toner particle dispersing agent are the values determined by calculation from the vaporization energy and molar volume of the atoms and atomic groups in accordance with Fedors as described in Coating Basics and Engineering (page 53, Yuji Harasaki, Converting Technical Institute).

The unit for the SP value in the present invention is $(cal/cm^3)^{1/2}$, but this can be converted to the $(J/m^3)^{1/2}$ unit using 1 $(cal/cm^3)^{1/2}=2.046\times10^3$ $(J/m^3)^{1/2}$.

The second term in formula (7) is a value that resembles the SP value of the polyester resin A-bonded toner particle dispersing agent. When formula (7) is satisfied, a force positioned between that for the liquid a and the polyester resin B acts for the polyester resin A-bonded toner particle dispersing agent. It is thought that this facilitates the presence of the polyester resin A-bonded toner particle dispersing agent at the interface between the toner particle and the liquid a and that the effects of the present invention are then even more substantially expressed.

Liquid Developer

In addition to the insulating liquid carrier, the toner particle dispersing agent, and the toner particle containing the polyester resin A and the polyester resin B, the liquid developer may as necessary contain a colorant, charge control agent, charge adjuvant, and other additives, as described below.

When the insulating liquid carrier of the liquid developer is a cationically polymerizable liquid monomer, a photopolymerization initiator, sensitizer, cationic polymerization inhibitor, and other additives may also be incorporated.

Insulating Liquid Carrier

The insulating liquid carrier exhibits an electrical insulating behavior and preferably has a volume resistivity of $1\times10^9$ to $1\times10^{13}$ Ω·cm. For example, it can be selected from the same materials as for the liquid a. Preferably liquid a is an insulating liquid carrier.

In specific terms, cationically polymerizable liquid monomers, e.g., vinyl ether compounds, and Moresco White MT-30P and so forth are preferred. Vinyl ether compounds are more preferred.

With regard to the insulating liquid carrier, when the liquid a used in the process A is of the appropriate type, it may be used as such as the carrier liquid of the liquid developer, or it may be replaced by a desired insulating liquid carrier by, for example, decantation or filtration. Considered from a productivity standpoint, in a more preferred embodiment an insulating liquid carrier is preliminarily used as the liquid a and is then used as such.

Colorant

The toner particle in the present invention may contain a colorant. There are no particular limitations on this colorant, and, for example, the following can be used: any generally commercially available organic pigment, organic dye, or inorganic pigment; a pigment dispersed in, for example, an insoluble resin as the dispersion medium; or a colorant provided by grafting a resin onto the surface of a pigment.

The following are specific examples of pigments that exhibit a yellow color:

C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

The following are examples of pigments that exhibit a red or magenta color:

C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C. I. Pigment Violet 19; and C. I. Vat Red 1, 2, 10, 13, 15, 23, 29, and 35.

The following are examples of pigments that exhibit a blue or cyan color:

C. I. Pigment Blue 2, 3, 15:2, 15:3, 15:4, 16, and 17; C. I. Vat Blue 6; C. I. Acid Blue 45; and copper phthalocyanine pigments in which 1 to 5 phthalimidomethyl groups are substituted on the phthalocyanine skeleton.

The following are examples of pigments that exhibit a green color:

C. I. Pigment Green 7, 8, and 36.

The following are examples of pigments that exhibit an orange color:

C. I. Pigment Orange 66 and 51.

The following are examples of pigments that exhibit a black color:

carbon black, titanium black, and aniline black.

The following are examples of pigments that exhibit a white color:

basic lead carbonate, zinc oxide, titanium oxide, and strontium titanate.

The content of the colorant, per 100 mass parts of the binder resin, is preferably 1 to 100 mass parts and more preferably 5 to 50 mass parts.

A dispersing means adapted to the toner particle production method should be used to disperse the pigment in the toner particle. Examples of devices that can be used as the dispersing means are ball mill, sand mill, attritor, roll mill, jet mill, homogenizer, paint shaker, kneader, agitator, Henschel mixer, colloid mill, ultrasound homogenizer, pearl mill, and wet jet mill.

A pigment dispersing agent may also be added during pigment dispersion. This pigment dispersing agent can be exemplified by hydroxyl group-containing carboxylate esters, salts between long-chain polyaminoamides and high molecular weight acid esters, salts of high molecular weight polycarboxylic acids, high molecular weight unsaturated acid esters, high molecular weight copolymers, modified polyacrylates, polybasic aliphatic carboxylic acids, naphthalenesulfonic acid/formalin condensates, polyoxyethylene alkyl phosphate esters, and pigment derivatives. The use of commercial high molecular weight dispersing agents, e.g., the Solsperse series (Lubrizol Japan Ltd.), is also preferred.

A synergist corresponding to various pigments may also be used as a pigment dispersion auxiliary. The amount of addition of these pigment dispersing agents and pigment dispersion auxiliaries is preferably from 1 mass parts to 50 mass parts per 100 mass parts of the pigment.

Charge Control Agent

The liquid developer may optionally contain a charge control agent. A known charge control agent may be used here.

The following are examples of specific compounds:

fats and oils such as linseed oil and soybean oil; alkyd resins; halogen polymers; aromatic polycarboxylic acids; acidic group-containing water-soluble dyes; oxidative condensates of aromatic polyamines; metal soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexanoate; sulfonate metal salts such as petroleum metal sulfonates and metal salts of sulfosuccinate esters; phospholipids such as hydrogenated lecithin and lecithin; metal salicylate salts such as metal complexes of t-butylsalicylic acid; as well as polyvinylpyrrolidone resins, polyamide resins, sulfonic acid-containing resins, and hydroxybenzoic acid derivatives.

The charge control agent optionally added to the liquid developer can be added after toner particle production. In the case of wet pulverization, it can be added during wet pulverization and/or after wet pulverization.

Charge Adjuvant

The toner particle may contain a charge adjuvant with the goal of adjusting the charging performance of the toner particle. A known charge adjuvant can be used as this charge adjuvant.

The following are examples of specific compounds: metal soaps such as zirconium naphthenate, cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, aluminum tristearate, and cobalt 2-ethylhexanoate; sulfonate metal salts such as petroleum metal sulfonates and metal salts of sulfosuccinate esters; phospholipids such as hydrogenated lecithin and lecithin; metal salicylate salts such as metal complexes of t-butylsalicylic acid; as well as polyvinylpyrrolidone resins, polyamide resins, sulfonic acid-containing resins, and hydroxybenzoic acid derivatives.

Other Additives

Besides the preceding, various known additives may be used on an optional basis in the liquid developer with the goals of improving the recording medium compatibility, storage stability, image storability, and other properties. For example, the following can be selected as appropriate and used: surfactants, lubricants, fillers, defoamants, ultraviolet absorbers, oxidation inhibitors, antifading agents, antimolds, rust inhibitors, and so forth.

Photopolymerization Initiator

The photopolymerization initiator is a compound that reacts to light at a designated wavelength and thereby generates an acid or a radical. Within the sphere of such compounds, cationic photopolymerization initiators can be exemplified by onium salt compounds, sulfone compounds, sulfonate ester compounds, sulfonimide compounds, and diazomethane compounds, but are not limited to these.

Moreover, when a cationic photopolymerization initiator is used in the present invention, the use is more preferred of a photopolymerization initiator represented by the following formula (8), which causes little reduction in the volume resistivity of ultraviolet curable liquids.

(8)

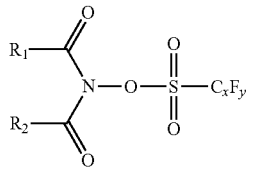

[In formula (8), $R_1$ and $R_2$ are bonded to each other to form a ring structure; x represents an integer from 1 to 8; and y represents an integer from 3 to 17.]

The ring structure formed by the bonding of $R_1$ with $R_2$ can be exemplified by 5-membered rings and 6-membered rings. These ring structures may also have the following as substituents: an alkyl group, an alkyloxy group, an alkylthio group, an aryl group, and an aryloxy group. Moreover, other, possibly substituted cyclic structures, e.g., alicyclic rings, heterocyclic rings, aromatic rings, and so forth, may also be condensed. Examples of preferred ring structures are succinimide structures, phthalimide structures, norbornene dicarboximide structures, naphthalene dicarboximide structures, cyclohexane dicarboximide structures, and epoxycyclohexene dicarboximide structures.

The $C_xF_y$ in general formula (8) can be exemplified by straight-chain alkyl groups in which the hydrogen atom has been substituted by the fluorine atom (RF1), branched-chain alkyl groups in which the hydrogen atom has been substituted by the fluorine atom (RF2), cycloalkyl groups in which the hydrogen atom has been substituted by the fluorine atom (RF3), and aryl groups in which the hydrogen atom has been substituted by the fluorine atom (RF4).

The straight-chain alkyl groups in which the hydrogen atom has been substituted by the fluorine atom (RF1) can be exemplified by the trifluoromethyl group (x=1, y=3), pentafluoroethyl group (x=2, y=5), nonafluorobutyl group (x=4, y=9), perfluorohexyl group (x=6, y=13), and perfluorooctyl group (x=8, y=17).

The branched-chain alkyl groups in which the hydrogen atom has been substituted by the fluorine atom (RF2) can be exemplified by the perfluoroisopropyl group (x=3, y=7), perfluoro-tert-butyl group (x=4, y=9), and perfluoro-2-ethylhexyl group (x=8, y=17).

The cycloalkyl groups in which the hydrogen atom has been substituted by the fluorine atom (RF3) can be exemplified by the perfluorocyclobutyl group (x=4, y=7), perfluorocyclopentyl group (x=5, y=9), perfluorocyclohexyl group (x=6, y=11), and perfluoro (1-cyclohexyl) methyl group (x=7, y=13).

The aryl groups in which the hydrogen atom has been substituted by the fluorine atom (RF4) can be exemplified by the pentafluorophenyl group (x=6, y=5) and 3-trifluoromethyltetrafluorophenyl group (x=7, y=7).

For the $C_xF_y$ in general formula (8), the straight-chain alkyl groups (RF1), branched-chain alkyl groups (RF2), and aryl groups (RF4) are preferred from the standpoint of the ease of acquisition and the decomposability of the sulfonate ester moiety. The straight-chain alkyl groups (RF1) and aryl groups (RF4) are more preferred, while the trifluoromethyl group (x=1, y=3), pentafluoroethyl group (x=2, y=5), heptafluoropropyl group (x=3, y=7), nonafluorobutyl group (x=4, y=9), and pentafluorophenyl group (x=6, y=5) are particularly preferred.

A single photopolymerization initiator can be used or two or more can be used in combination. The content of the photopolymerization initiator in the liquid developer is not particularly limited, but, expressed per 100 mass parts of the cationically polymerizable liquid monomer, is preferably from 0.01 mass parts to 5 mass parts, more preferably from 0.05 mass parts to 1 mass parts, and even more preferably from 0.1 mass parts to 0.5 mass parts.

Specific examples of the photopolymerization initiator with formula (8) [exemplary compounds A-1 to A-27] are provided below, but the present invention is not limited to or by these examples.

(A-1)

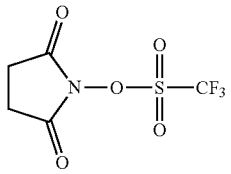

(A-2)

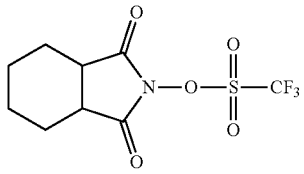

-continued (A-3)

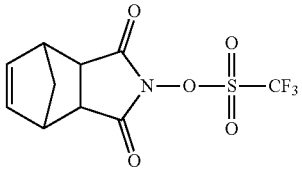

(A-4)

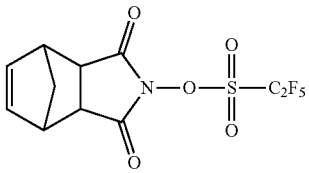

(A-5)

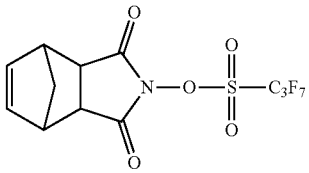

(A-6)

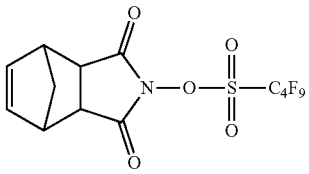

(A-7)

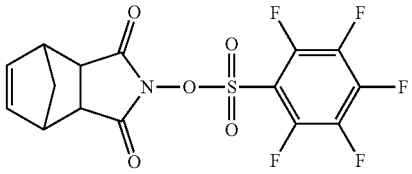

(A-8)

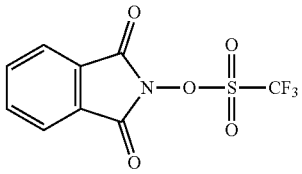

(A-9)

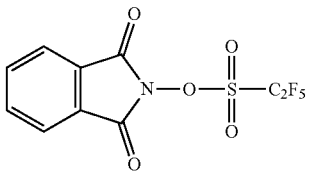

(A-10)

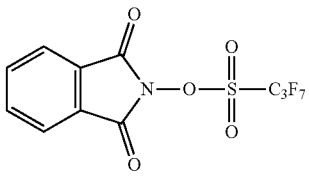

-continued
(A-11)
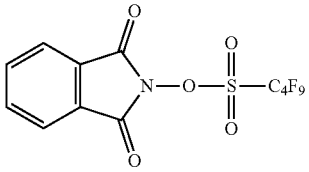
(A-12)
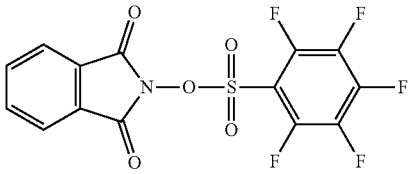
(A-13)
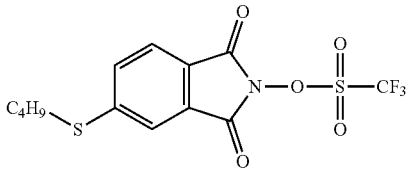
(A-14)
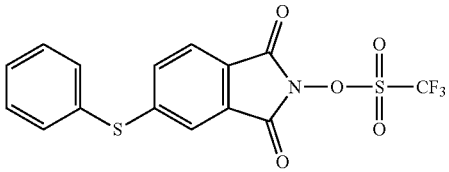
(A-15)
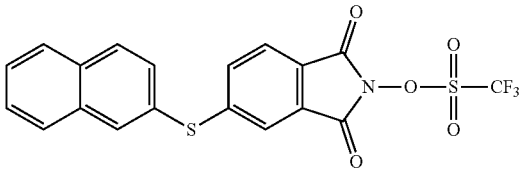
(A-16)
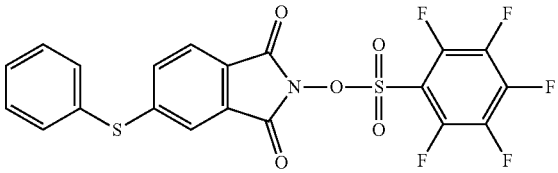
(A-17)
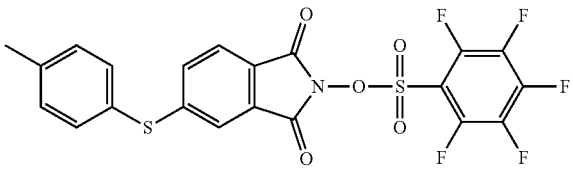
(A-18)
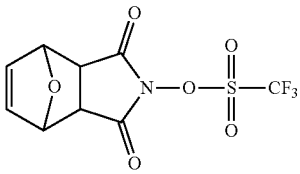
-continued
(A-19)
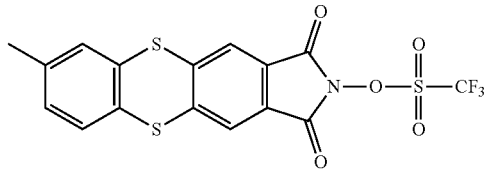
(A-20)
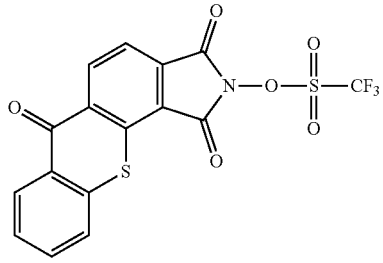
(A-21)
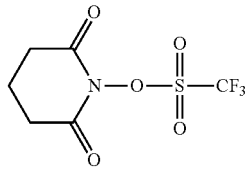
(A-22)
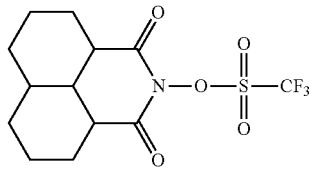
(A-23)
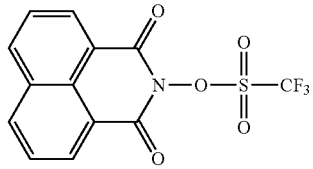
(A-24)
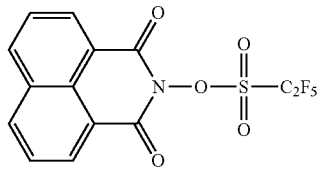
(A-25)
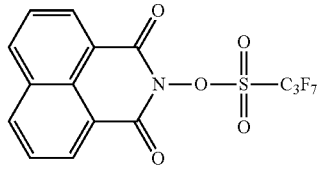
(A-26)
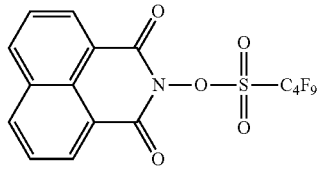

-continued (A-27)

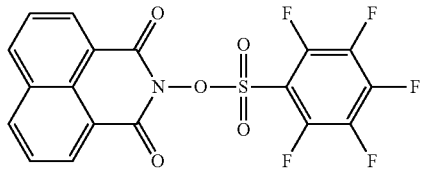

Additives

Additives such as the following are preferably incorporated on an optional basis when the liquid developer is made into a cationically polymerizable, ultraviolet-curable liquid developer.

Sensitizer

A sensitizer may be added on an optional basis to the cationically polymerizable, ultraviolet-curable liquid developer with the goals of improving the acid-generating efficiency of the photo-acid generator, extending the photosensitive wavelengths to longer wavelengths, and so forth. Any sensitizer may be used that is capable of sensitizing the photopolymerization initiator through an electron transfer mechanism or energy transfer mechanism.

Preferred examples are aromatic polycondensed ring compounds such as anthracene, 9,10-dialkoxyanthracene, pyrene, and perylene; aromatic ketone compounds such as acetophenone, benzophenone, thioxanthone, and Michler's ketone; and heterocyclic compounds such as phenothiazine and N-aryloxazolidinone. The amount of addition is selected as appropriate in correspondence to the goal, and generally preferably from 0.1 mass parts to 10 mass parts and more preferably from 1 mass parts to 5 mass parts is used per 1 mass parts of the polymerization initiator.

In a preferred embodiment, a co-sensitizer is also added to the cationically polymerizable, ultraviolet-curable liquid developer with the goal of improving the electron transfer efficiency or energy transfer efficiency between the aforementioned sensitizer and the photopolymerization initiator. The co-sensitizer can be specifically exemplified by the following: naphthalene compounds such as 1,4-dihydroxynaphthalene, 1,4-dimethoxynaphthalene, 1,4-diethoxynaphthalene, 4-methoxy-1-naphthol, and 4-ethoxy-1-naphthol, and benzene compounds such as 1,4-dihydroxybenzene, 1,4-dimethoxybenzene, 1,4-diethoxybenzene, 1-methoxy-4-phenol, and 1-ethoxy-4-phenol.

The amount of co-sensitizer addition is selected as appropriate in correspondence to the goal, but is, per 1 mass parts of the sensitizer, preferably from 0.1 mass parts to 10 mass parts and more preferably from 0.5 mass parts to 5 mass parts.

Cationic Polymerization Inhibitor

A cationic polymerization inhibitor may also be added to the cationically polymerizable, ultraviolet-curable liquid developer. The cationic polymerization inhibitor can be exemplified by alkali metal compounds and/or alkaline-earth metal compounds and by amines.

Alkanolamines, N,N-dimethylalkylamines, N,N-dimethylalkenylamines, and N,N-dimethylalkynylamines are preferred for the amines and can be specifically exemplified by triethanolamine, triisopropanolamine, tributanolamine, N-ethyldiethanolamine, propanolamine, n-butylamine, sec-butylamine, 2-aminoethanol, 2-methylaminoethanol, 3-methylamino-1-propanol, 3-methylamino-1,2-propanediol, 2-ethylaminoethanol, 4-ethylamino-1-butanol, 4-(n-butylamino)-1-butanol, 2-(t-butylamino)ethanol, N,N-dimethylundecanolamine, N,N-dimethyldodecanolamine, N,N-dimethyltridecanolamine, N,N-dimethyltetradecanolamine, N,N-dimethylpentadecanolamine, N,N-dimethylnonadecylamine, N,N-dimethylicosylamine, N,N-dimethyleicosylamine, N,N-dimethylheneicosylamine, N,N-dimethyldocosylamine, N,N-dimethyltricosylamine, N,N-dimethyltetracosylamine, N,N-dimethylpentacosylamine, N,N-dimethylpentanolamine, N,N-dimethylhexanolamine, N,N-dimethylheptanolamine, N,N-dimethyloctanolamine, N,N-dimethylnonanolamine, N,N-dimethyldecanolamine, N,N-dimethylnonylamine, N,N-dimethyldecylamine, N,N-dimethylundecylamine, N,N-dimethyldodecylamine, N,N-dimethyltridecylamine, N,N-dimethyltetradecylamine, N,N-dimethylpentadecylamine, N,N-dimethylhexadecylamine, N,N-dimethylheptadecylamine, and N,N-dimethyloctadecylamine. In addition to these, for example, a quaternary ammonium salt may also be used. The cationic polymerization inhibitor is particularly preferably a secondary amine.

The amount of addition of the cationic polymerization inhibitor is preferably from 10 ppm to 5,000 ppm on a mass basis in the ultraviolet-curable liquid developer.

Toner Particle Production Process A

The toner particle production process A is described in detail in the following. The process A in the present invention has a step of particulating a mixture of the polyester resin A, the polyester resin B, and the toner particle dispersing agent in a liquid a by applying shear force to the mixture, and a step of producing a toner particle in the liquid a via a molten state.

For example, in a general method, heating and kneading are carried out using, e.g., a three-roll mill, twin-screw extruder, and so forth, at a temperature higher than the softening points of both resins, i.e., the polyester resin A and the polyester resin B, followed by a dry pulverization using a pulverizer, e.g., a hammer mill, jet mill, pin mill, turbo mill, cutter mill, ball mill, and so forth, to obtain a finely particulated material.

The liquid a and the toner particle dispersing agent are then added to this finely particulate material and a wet pulverization is subsequently performed using a wet pulverizer such as a media-based disperser, e.g., an attritor, sand mill, Dyno mill, ball mill, DCP mill, Apex mill, pearl mill, and so forth, or such as a media-free pulverizer, e.g., an Ultimizer (Sugino Machine Limited), Nanomizer (Nanomizer Inc.), and so forth. By doing this, shear force is applied to the mixture and particulation can be brought about and a suspension containing toner particles in the liquid a can be produced. There is no particular limitation on the applied shear force, and it should be selected as appropriate in conformity with the desired particle diameter.

By proceeding through a molten state in the liquid a, and in accordance with the specified sequence for the SP values, the polyester resin B moves into the interior of the toner particle; orientation of the toner particle dispersing agent and polyester resin A, while they are in a state of adsorptive interaction, to the toner particle surface is facilitated; and a toner having an excellent dispersion stability can be produced.

In order to establish a molten state, for example, as a general method it is sufficient to establish a temperature higher than the softening points of both resins, i.e., the polyester resin A and the polyester resin B. For example, a hot plate, oil bath, oven, thermostat, and so forth, may be used without particular limitation. The temperature conditions are, for example, heating for preferably 10 minutes to 1,440 minutes and more preferably for 20 minutes to 360 minutes, at preferably 60° C. to 200° C. and more preferably 80° C. to 150° C. In addition, coarsening of the pulverized particles can be prevented during the melt interval by, as necessary, causing the suspension to undergo a gentle flow using, for example, a stirring bar, stirring blade, mixing rotor, shaker, and so forth.

Toner Particle Production Process B

The toner particle production process B is described in detail in the following.

The process B in the present invention has a step of dissolving, in a solvent b, a mixture of the polyester resin A, the polyester resin B, and the toner particle dispersing agent;

a step of mixing the resulting solution with the liquid a and applying shear force to particulate the mixture in the liquid a and provide a toner particle; and a step of distillatively removing the solvent b.

As a general method, for example, the toner particle may also be produced by the coacervation method.

First, using a solvent b that dissolves the polyester resin A, the polyester resin B, and the toner particle dispersing agent, their mixture is dissolved therein with thorough stirring. Then, while adding the liquid a, the mixture is particulated by applying a shear force to produce a suspension that contains the toner particle in the liquid a and solvent b.

The shear force may be set as appropriate in conformity with the desired particle diameter. With regard to high-velocity shearing apparatuses capable of applying a high shear force, dispersers that operate by high-speed stirring, e.g., homogenizers, homomixers, and so forth, which apply a stirring shear, can uniformly apply a high shear force to the toner particle and are thus preferred. With regard to capacity, rotation rate, configuration, and so forth, various such apparatuses are available, and the appropriate apparatus should be selected in conformity with the production mode.

The rotation rate in the case of use of a homogenizer is preferably from 500 rpm to 30,000 rpm and is more preferably from 13,000 rpm to 28,000 rpm. The temperature in the mixing step is preferably at least the freezing points and not more than the boiling points of the solvent b and liquid a. The range from 0° C. to 60° C. is specifically preferred.

The step of distillatively removing the solvent b is then carried out. The solvent b is distillatively removed from the suspension containing toner particles in the liquid a and solvent b. For example, a method such as evaporation is suitable for the distillative removal method. For the conditions, distillative removal at 0° C. to 60° C. under reduced pressure at a pressure of 1 to 200 kPa is preferred. The execution of the distillative removal step produces a suspension containing toner particles in the liquid a.

Liquid Developer Production Process

The liquid developer production process is described in detail in the following.

With regard to the suspension containing toner particles in the liquid a, as produced in the toner particle production process A, the liquid a can be used as such as long as this poses no problems with respect to the properties of the liquid developer, e.g., resistance, volatility, and so forth. While substitution may as necessary be carried out by a method such as filtration or decantation to an insulating liquid carrier c suitable as a carrier for liquid developers, the use of liquid a as such is desirable from the standpoint of mass productivity.

Solvent b

A solvent can be used when the toner particle is produced by the coacervation method. The solvent b preferably can dissolve the polyester resin A, the polyester resin B, and the toner particle dispersing agent. Examples here are ethers such as tetrahydrofuran, ketones such as methyl ethyl ketone and cyclohexanone, esters such as ethyl acetate, and halogenated compounds such as chloroform. This may also be an aromatic hydrocarbon capable of dissolving the resins, e.g., toluene, benzene, and so forth.

Image-Forming Apparatus

The liquid developer can be advantageously used in ordinary or common image-forming apparatuses that employ an electrophotographic system.

EXAMPLES

The present invention is described in detail in the following using examples, but the present invention is not limited to or by these examples. Unless specifically indicated otherwise, "parts" and "%" denote, respectively, "mass parts" and "mass %".

Measurement Methods

The measurement methods using in the examples are described in the following. (1) Method for Measuring Molecular Weight [Weight-average Molecular Weight (Mw) and Number-average Molecular Weight (Mn)]

The molecular weight of, e.g., the resins, was determined on a polystyrene basis using gel permeation chromatography (GPC). The measurement of molecular weight by GPC was carried out as described in the following.

Sample sufficient to provide a sample concentration of 1.0 mass % was added to the eluent indicated below, and a solution in which the sample was dissolved was prepared by standing for 24 hours at room temperature. This solution was filtered across a solvent-resistant membrane filter having a pore diameter of 0.20 μm to provide the sample solution, and the measurement was run using the following conditions.

Instrument: "HLC-8220GPC" high-performance GPC instrument [Tosoh Corporation]

Column: 2×LF-804

Eluent: tetrahydrofuran (THF)

Flow rate: 1.0 mL/min

Oven temperature: 40° C.

Sample injection amount: 0.025 mL

A molecular weight calibration curve constructed using polystyrene resin standards [Tosoh Corporation, TSK Standard Polystyrene F-850, F-450, F-288, F-128, F-80, F-40, F-20, F-10, F-4, F-2, F-1, A-5000, A-2500, A-1000, A-500] was used to determine the molecular weight of the sample.

(2) Method for Measuring Acid Value

The acid value of the resins is determined using the following method.

The basic procedure is based on JIS K 0070.

1) 0.5 to 2.0 g of the sample is exactly weighed. This mass is designated M1 (g).

2) The sample is introduced into a 50-mL beaker. 25 mL of a tetrahydrofuran/ethanol mixed solvent (2/1) is added and dissolution is carried out.

3) Titration is performed using a 0.1 mol/L ethanolic KOH solution and a potentiometric titrator [a "COM-2500" Automatic Titrator from Hiranuma Sangyo Co., Ltd. can be used].

4) The amount of the KOH solution used here is designated A (mL). The blank is measured at the same time, and the amount of KOH used in this case is designated B (mL).

5) The acid value is calculated using the following formula (i). Here, f refers to the factor for the KOH solution.

$$\text{Acid Value [mg } KOH/\text{g]} = \frac{[(A+B)\times f\times 5.61]}{M1} \quad \text{(i)}$$

(3) Methods for Measuring Amine Value

The amine value of the resins and the toner particle dispersing agents is determined using the following method.

The basic procedure is based on ASTM D 2074.

1) 0.5 to 2.0 g of the sample is exactly weighed. This mass is designated M (g).

2) The sample is introduced into a 50-mL beaker. 25 mL of tetrahydrofuran/ethanol mixed solvent (3/1) is added and dissolution is carried out.

3) Titration is performed using a 0.1 mol/L ethanolic HCl solution and a potentiometric titrator [a "COM-2500" Automatic Titrator from Hiranuma Sangyo Co., Ltd. can be used].

4) The amount of the HCl solution used here is designated S (mL). The blank is measured at the same time, and the amount of HCl used in this case is designated B (mL).

5) The amine value is calculated using the following formula. Here, f is the factor for the HCl solution.

$$\text{Amine Value [mg } KOH/\text{g]} = \frac{(S-B)\times f\times 5.61}{M}$$

Measurement of Acid Value of Toner Particle and Amine Value of Toner Dispersing Agent from Liquid Developer The following method is used to determine the acid value of the binder resin and the amine value of the toner dispersing agent contained in the toner particle in the ultraviolet-curable liquid developer.

1) Approximately 10 g of the ultraviolet-curable liquid developer is subjected to centrifugal separation: the toner particles are sedimented and the supernatant is discarded.

2) Hexane is then added to the toner particles with thorough stirring followed by centrifugal separation: the toner particles are sedimented and the supernatant is discarded. This sequence is carried out three times followed by thorough drying.

3) 10 g of tetrahydrofuran is added to 2) and standing overnight is carried out. After thorough stirring, this is then subjected to centrifugal separation and the tetrahydrofuran-insoluble component is removed. The tetrahydrofuran-soluble component (binder resin and toner particle dispersing agent mixture) in the supernatant is thoroughly dried.

4) Using the methods described above, the acid value and amine value are measured on the tetrahydrofuran-soluble component obtained in 3).

In addition, as necessary:

(i) the toner particle obtained in 2) above is dissolved in deuterochloroform and the primary amino group-bearing polymer and the polyester resin constituting the toner particle are subjected to compositional analysis using a JNM-ECA ($^1$H-NMR) Fourier-transform nuclear magnetic resonance instrument from JEOL Ltd.;

(ii) on the other hand, the number-average molecular weight (Mn) of the tetrahydrofuran-soluble component obtained in 3) above is determined using gel permeation chromatography (GPC), and the number-average degree of polymerization of the polyester resin and the average degree of polymerization of the primary amino group-bearing polymer are determined from the results in (i) and (ii).

Polyester Resin A Production Examples

Polyester PESA-1 Production Example

The following were introduced into a reaction kettle equipped with a stirrer, thermometer, and reflux condenser and subjected to an esterification reaction for 2 hours at 220° C.: 82 parts of terephthalic acid, 82 parts of isophthalic acid, 212 parts of the 2 mol adduct of ethylene oxide on bisphenol A, 48 parts of ethylene glycol, 31 parts of neopentyl glycol, 0.1 parts of n-tetrabutyl titanate as catalyst, 2 parts of Irganox 1330 (BASF Japan Ltd.) as antioxidant, and 0.3 parts of sodium acetate as polymerization stabilizer.

The pressure within the system was then reduced while raising the temperature of the reaction system from 220° C. to 270° C., and a polycondensation reaction was subsequently run for 10 minutes at or below 1 Torr. After completion of the reaction, the system was returned from the vacuum to normal pressure using nitrogen. 21 parts of trimellitic anhydride was introduced as the polycarboxylic acid that would provide the acid value, and a reaction was run for 30 minutes at 220° C. to obtain a polyester.

100 parts of the obtained polyester was dissolved in 200 parts of chloroform; this was introduced along with 300 parts of deionized water into a separatory funnel; agitation and standing at quiescence were performed; and the upper layer was discarded. The lower layer was washed twice with water followed by distillative removal of the chloroform using an evaporator to obtain the polyester PESA-1.

Polyester Resin A PESA-2 Production Example

The following were introduced into a reaction kettle equipped with a stirrer, thermometer, and reflux condenser and subjected to an esterification reaction for 2 hours at 220° C.: 82 parts of terephthalic acid, 82 parts of isophthalic acid, 14 parts of trimellitic anhydride, 212 parts of the 2 mol adduct of ethylene oxide on bisphenol A, 48 parts of ethylene glycol, 31 parts of neopentyl glycol, 0.1 parts of n-tetrabutyl titanate as catalyst, 2 parts of Irganox 1330 as antioxidant, and 0.3 parts of sodium acetate as polymerization stabilizer. The pressure within the system was then reduced while raising the temperature of the reaction system from 220° C. to 270° C., and a polycondensation reaction was subsequently run for 11 minutes at or below 1 Torr. After completion of the reaction, the system was returned from the vacuum to normal pressure using nitrogen to yield the polyester PESA-2.

Polyester Resins A PESA-3 to PESA-5 and Polyester Resins A PESA-101 to PESA-104 Production Examples Polyester resins A PESA-3 to PESA-5 and polyester resins A PESA-101 to PESA-104 were obtained by the same reaction, but changing the method described in the example for the synthesis of polyester PESA-2 to the method described in Table 1.

TABLE 1

| | BPA-EO | EG | NPG | TPA | IPA | TMA | Time of addition of trimellitic anhydride | Polycondensation reaction time [min] |
|---|---|---|---|---|---|---|---|---|
| PESA-1 | 212 | 48 | 31 | 82 | 82 | 21 | After polycondensation | 10 |
| PESA-2 | 212 | 48 | 31 | 82 | 82 | 14 | Before polycondensation | 11 |
| PESA-3 | 212 | 48 | 31 | 82 | 82 | 14 | Before polycondensation | 7 |
| PESA-4 | 35 | 129 | 31 | 82 | 82 | 10 | Before polycondensation | 19 |
| PESA-5 | 35 | 129 | 31 | 82 | 82 | 6 | Before polycondensation | 20 |
| PESA-101 | 212 | 48 | 31 | 82 | 82 | 14 | Before polycondensation | 27 |
| PESA-102 | 212 | 48 | 31 | 82 | 82 | 14 | Before polycondensation | 3 |
| PESA-103 | 212 | 48 | 31 | 82 | 82 | 4 | Before polycondensation | 10 |
| PESA-104 | 212 | 48 | 31 | 82 | 82 | 0 | No addition | 10 |

The numerical value for each monomer in the table indicates mass parts.

TABLE 2

| | BPA-EO | EG | NPG | TPA | IPA | TMA | Position of trimellitic anhydride | Mn | n | SP value | Acid value |
|---|---|---|---|---|---|---|---|---|---|---|---|
| PESA-1 | 6 | 3 | 1 | 5 | 5 | 1 | Terminal position | 4,100 | 9.8 | 11.8 | 14 |
| PESA-2 | 6 | 3 | 1 | 5 | 5 | 0.7 | In main chain | 4,200 | 10.0 | 11.8 | 10 |
| PESA-3 | 6 | 3 | 1 | 5 | 5 | 0.7 | In main chain | 3,100 | 7.4 | 11.8 | 10 |
| PESA-4 | 1 | 8 | 1 | 5 | 5 | 0.5 | In main chain | 6,800 | 24.0 | 12.5 | 10 |
| PESA-5 | 1 | 8 | 1 | 5 | 5 | 0.3 | In main chain | 6,900 | 24.3 | 12.4 | 5 |
| PESA-101 | 6 | 3 | 1 | 5 | 5 | 0.7 | In main chain | 9,000 | 21.4 | 11.8 | 10 |
| PESA-102 | 6 | 3 | 1 | 5 | 5 | 0.7 | In main chain | 2,000 | 4.8 | 11.8 | 10 |
| PESA-103 | 6 | 3 | 1 | 5 | 5 | 0.2 | In main chain | 4,000 | 9.5 | 11.7 | 3 |
| PESA-104 | 6 | 3 | 1 | 5 | 5 | 0 | No addition | 4,100 | 9.8 | 11.7 | 1 |

In Table 2, the numerical values for each monomer in the obtained polyester are the results (molar ratio) from NMR measurement of the obtained polyester resin. The unit for the SP value is $(cal/cm^3)^{1/2}$, and the unit for the acid value is mg KOH/g. The abbreviations used in the tables and elsewhere have the following definitions.

BPA-EO: 2 mol ethylene oxide adduct on bisphenol A
EG: ethylene glycol
NPG: neopentyl glycol
TPA: terephthalic acid
IPA: isophthalic acid
TMA: trimellitic anhydride
Mn: number-average molecular weight
n: number-average degree of polymerization Polyester Resin B (PESB-1) Production Example The following were introduced into a reaction kettle equipped with a stirrer, thermometer, and reflux condenser and subjected to an esterification reaction for 2 hours at 220° C.: 82 parts of terephthalic acid, 82 parts of isophthalic acid, 5 parts of monosodium 5-sulfoisophthalate, 80 parts of ethylene glycol, 153 parts of neopentyl glycol, 0.1 parts of n-tetrabutyl titanate as catalyst, 2 parts of Irganox 1330 as antioxidant, and 0.3 parts of sodium acetate as polymerization stabilizer. The pressure within the system was then reduced while raising the temperature of the reaction system from 220° C. to 270° C., and a polycondensation reaction was subsequently run for 20 minutes at or below 1 Torr. After completion of the reaction, the system was returned from the vacuum to normal pressure using nitrogen to yield a polyester PESB-1.

Polyester Resins B PESB-2 to PESB-5 and Polyester Resins B PESB-101 to PESB-103 Production Examples Polyester resins B PESB-2 to PESB-5 and PESB-101 to PESB-103 were obtained by the same reaction, but changing the method described in the example for the synthesis of polyester PESB-1 to the method described in Table 3.

TABLE 3

| | BPA-EO | EG | NPG | TPA | IPA | TMA | SIPA | Polycondensation reaction time [min] | Acid value |
|---|---|---|---|---|---|---|---|---|---|
| PESB-1 | 0 | 80 | 153 | 82 | 82 | 0 | 5 | 20 | Not more than 2 |
| PESB-2 | 0 | 80 | 153 | 82 | 82 | 0 | 0 | 20 | Not more than 2 |
| PESB-3 | 0 | 80 | 153 | 82 | 82 | 0 | 0 | 10 | Not more than 2 |
| PESB-4 | 248 | 0 | 92 | 82 | 82 | 0 | 0 | 11 | Not more than 2 |
| PESB-5 | 248 | 0 | 92 | 82 | 82 | 0 | 0 | 62 | Not more than 2 |
| PESB-101 | 0 | 80 | 153 | 82 | 82 | 0 | 0 | 73 | Not more than 2 |
| PESB-102 | 0 | 80 | 153 | 82 | 82 | 0 | 0 | 8 | Not more than 2 |
| PESB-103 | 0 | 80 | 153 | 82 | 82 | 6 | 0 | 10 | 5 |

The numerical value for each monomer in the table indicates mass parts.

TABLE 4

| | BPA-EO | EG | NPG | TPA | IPA | TMA | SIPA | Mn | SP value | Acid value |
|---|---|---|---|---|---|---|---|---|---|---|
| PESB-1 | 0 | 5 | 5 | 5 | 5 | 0 | 0.2 | 7,100 | 12.1 | Not more than 2 |
| PESB-2 | 0 | 5 | 5 | 5 | 5 | 0 | 0 | 7,100 | 12.0 | Not more than 2 |
| PESB-3 | 0 | 5 | 5 | 5 | 5 | 0 | 0 | 4,100 | 12.0 | Not more than 2 |
| PESB-4 | 7 | 0 | 3 | 5 | 5 | 0 | 0 | 4,200 | 11.4 | Not more than 2 |
| PESB-5 | 7 | 0 | 3 | 5 | 5 | 0 | 0 | 19,600 | 11.4 | Not more than 2 |
| PESB-101 | 0 | 5 | 5 | 5 | 5 | 0 | 0 | 23,000 | 12.0 | Not more than 2 |
| PESB-102 | 0 | 5 | 5 | 5 | 5 | 0 | 0 | 3,500 | 12.0 | Not more than 2 |
| PESB-103 | 0 | 5 | 5 | 5 | 5 | 0.3 | 0 | 4,000 | 12.1 | 5 |

In Table 4, the numerical values for each monomer in the obtained polyester are the results (molar ratio) from NMR measurement of the obtained polyester resin. The abbreviations are the same as those for Tables 1 and 2.

SIPA represents monosodium 5-sulfoisophthalate.

12-Hydroxystearic Acid Self-Condensate (P-1) Production Example 30.0 parts of xylene (Junsei Chemical Co., Ltd.), 300.0 parts of 12-hydroxystearic acid (Junsei Chemical Co., Ltd.), and 0.1 parts of tetrabutyl titanate (Tokyo Chemical Industry Co., Ltd.) were introduced into a reaction flask fitted with a thermometer, stirrer, nitrogen introduction line, reflux condenser, and water separator, and the temperature was raised over 4 hours to 160° C. under a nitrogen current. Heating was carried out for an additional 4 hours at 160° C. (the acid value at this point was approximately 20 mg KOH/g), and the xylene was distillatively removed at 160° C.

This was followed by cooling to room temperature; the water produced during the reaction under heating was separated from the xylene in the distillate; and this xylene was returned to the reaction solution. This reaction solution is designated below as 12-hydroxystearic acid self-condensate P-1. The polyester present in the 12-hydroxystearic acid self-condensate P-1 had the following properties: number-average molecular weight=2,550, acid value=22.0 mg KOH/g. Moreover, the thusly produced polyester can be used as a starting material for the synthesis of polyallylamine derivatives in a form associated with solvent (xylene).

Toner Particle Dispersing Agent Production Examples

Toner Particle Dispersing Agent Dis-1 Synthesis Example

A mixture of 25.0 parts of xylene and 70 parts of a 10% aqueous polyallylamine solution ("PAA-1LV", Nittobo Medical Co., Ltd., number-average molecular weight=approximately 3,000) was introduced into a reaction flask fitted with a thermometer, stirrer, nitrogen introduction line, and reflux condenser and heating was carried out to 160° C. while stirring. While distilling off the water using a separator and refluxing the xylene to the reaction solution, 12.8 parts of the 12-hydroxystearic acid self-condensate P-1 from the 12-Hydroxystearic Acid Self-Condensate (P-1) Production Example, heated to 160° C., was added thereto and a reaction was run at 160° C. for 2 hours to obtain a toner particle dispersing agent Dis-1 (amine value=60.0 mg KOH/g).

Toner Particle Dispersing Agents Dis-2 and Dis-101 Production Example

Toner particle dispersing agents Dis-2 and Dis-101 were obtained by the same reaction as in the Toner Particle Dispersing Agent Dis-1 Synthesis Example, except for the amount of addition of the P-1.

TABLE 5

| | polyallylamine | amount of P-1 addition | amine value of toner dispersing agent |
|---|---|---|---|
| Dis-1 | PAA-1LV | 12.8 | 60 |
| Dis-2 | PAA-1LV | 13.8 | 40 |
| Dis-101 | PAA-1LV | 14.8 | 20 |

Example of Liquid Developer Production by Wet Pulverization

Example 1

Liquid Developer Production Example (Process A)

21.6 parts of polyester resin A (PESA-1), 14.4 parts of polyester resin B (PESB-1), Pigment Blue 15:3 (9 parts), and 15 parts of Vylon UR4800 (Toyobo Co., Ltd., resin concentration=32%) were thoroughly mixed in a Henschel mixer and were then melt-kneaded using a co-rotating twin-screw extruder using a roll inner heating temperature of 100° C. The obtained mixture was cooled and coarsely pulverized to obtain a coarsely pulverized toner particle.

The following were then mixed for 48 hours using a sand mill: 160 parts Moresco White MT-30P (SP value=7.90) as liquid a, 40 parts of the coarsely pulverized toner particle obtained as described above, and 0.8 parts of the toner particle dispersing agent Dis-1. A toner particle dispersion T-1 was then obtained by stirring at 200 rpm under reflux while heating for 1 hour at 120° C. on an EC oil bath stirrer (AS ONE Corporation).

The liquid developer of Example 1 was obtained by mixing 0.10 parts of hydrogenated lecithin (Lecinol S-10, Nikko Chemicals Co., Ltd.) as a charge control agent into 10 parts of the obtained toner particle dispersion T-1.

Example 2

Liquid Developer Production Example (Process B)

Pigment Dispersion Production Step

Pigment Dispersion Production Example

Pigment Blue 15:3 (30 parts), Vylon UR4800 (47 parts), 255 parts of tetrahydrofuran, and 130 parts of glass beads (1 mm Ø) were mixed; dispersion was performed for 3 hours using an attritor [Nippon Coke & Engineering Co., Ltd.]; and filtration across a mesh was carried out to obtain a kneaded material.

180 parts of the obtained kneaded material, 69 parts of a 50% tetrahydrofuran solution of polyester resin A (PESA-1), 46 parts of a 50% tetrahydrofuran solution of polyester resin B (PESB-1), and 2.7 parts of the toner particle dispersing agent Dis-1 were mixed using a high-speed disperser (T. K.

Robomix/T. K. Homodisper Model 2.5 blade, PRIMIX Corporation) and were mixed while stirring at 40° C. to obtain a pigment dispersion.

Mixture Production Example

A mixture was obtained by adding 70 parts of Moresco White MT-30P as liquid a in small portions to 100 parts of the obtained pigment dispersion while stirring at high speed (25,000 rpm) using a homogenizer (Ultra-Turrax T50, IKA).

Distillative Removal Step

The resulting mixture was transferred to a recovery flask and the tetrahydrofuran was completely distilled off at 50° C. while performing ultrasound dispersion to obtain a toner particle dispersion T-2.

Liquid Developer Preparation Step

The liquid developer of Example 2 was obtained by mixing 0.10 parts of hydrogenated lecithin (Lecinol S-10, Nikko Chemicals Co., Ltd.) as a charge control agent into 10 parts of the obtained toner particle dispersion T-2.

Example 3

Liquid Developer Production Example

A toner particle dispersion T-3 was obtained using the same method as in Example 1, but using octane (SP value=7.6) as the liquid a.

10 parts of the obtained toner particle dispersion T-3 was subjected to centrifugal separation; the supernatant was removed by decantation; replacement was carried out using fresh MT-30P in the same mass as the supernatant that had been removed; and 0.10 parts of hydrogenated lecithin (Lecinol S-10, Nikko Chemicals Co., Ltd.) was admixed as charge control agent to obtain the liquid developer of Example 3.

Examples 4 to 14 and Comparative Examples 1 to 11

Liquid Developer Production Example

The liquid developers of Examples 4 to 14 and Comparative Examples 1 to 11 were obtained operating by the same method as described in the example of the synthesis of the liquid developer of Example 3, but changing to the parameters given in Table 6.

TABLE 6

| Example No. | Polyester resin A | Polyester resin B | Toner particle dispersing agent | B/(A + B) | Production Procedure | Production Liquid a | Insulating liquid carrier |
|---|---|---|---|---|---|---|---|
| 1 | PESA-1 | PESB- 1 | Dis-1 | 0.4 | WP | MT-30P | MT-30P |
| 2 | PESA-1 | PESB- 1 | Dis-1 | 0.4 | CO | MT-30P | MT-30P |
| 3 | PESA-1 | PESB- 1 | Dis-1 | 0.4 | WP | Octane | MT-30P |
| 4 | PESA-1 | PESB- 1 | Dis-1 | 0.8 | WP | Octane | MT-30P |
| 5 | PESA-1 | PESB- 1 | Dis-1 | 0.3 | WP | Octane | MT-30P |
| 6 | PESA-1 | PESB- 1 | Dis-2 | 0.3 | WP | Octane | MT-30P |
| 7 | PESA-2 | PESB- 1 | Dis-2 | 0.3 | WP | Octane | MT-30P |
| 8 | PESA-2 | PESB- 2 | Dis-2 | 0.3 | WP | Octane | MT-30P |
| 9 | PESA-3 | PESB- 2 | Dis-2 | 0.3 | WP | Octane | MT-30P |
| 10 | PESA-3 | PESB-3 | Dis-2 | 0.3 | WP | Octane | MT-30P |
| 11 | PESA-4 | PESB-4 | Dis-2 | 0.3 | WP | Octane | MT-30P |
| 12 | PESA-5 | PESB-4 | Dis-2 | 0.3 | WP | Octane | MT-30P |
| 13 | PESA-4 | PESB-5 | Dis-2 | 0.3 | WP | Octane | MT-30P |
| 14 | PESA-4 | PESB-4 | Dis-2 | 0.9 | WP | Octane | MT-30P |
| C.E. 1 | PESA-101 | PESB-4 | Dis-2 | 0.3 | WP | Octane | MT-30P |
| C.E. 2 | PESA-102 | PESB-4 | Dis-2 | 0.3 | WP | Octane | MT-30P |
| C.E. 3 | PESA-103 | PESB-4 | Dis-2 | 0.3 | WP | Octane | MT-30P |
| C.E. 4 | PESA-104 | PESB-4 | Dis-2 | 0.3 | WP | Octane | MT-30P |
| C.E. 5 | PESA-4 | PESB-101 | Dis-2 | 0.3 | WP | Octane | MT-30P |
| C.E. 6 | PESA-4 | PESB-102 | Dis-2 | 0.3 | WP | Octane | MT-30P |
| C.E. 7 | PESA-4 | PESB-103 | Dis-2 | 0.3 | WP | Octane | MT-30P |
| C.E. 8 | PESA-4 | PESB-4 | Dis-101 | 0.3 | WP | Octane | MT-30P |
| C.E. 9 | PESA-4 | PESB-4 | Dis-2 | 1.0 | WP | Octane | MT-30P |
| C.E. 10 | PESA-4 | PESB-4 | Dis-2 | 0.2 | WP | Octane | MT-30P |
| C.E. 11 | PESA-4 | PESB-4 | Dis-2 | 0.3 | WP | EtOH | MT-30P |
| C.E. 12 | FC1565 | V220 | PB817 | 0.9 | CO | P-40 | P-40 |
| C.E. 13 | PESA-105 | PESB-104 | PB817 | 0.4 | CO | MT-30P | MT-30P |

In Table 6, C. E. denotes Comparative Example; WP denotes Wet pulverization; CO denotes Coacervation; MT-30P denotes Moresco White MT-30P (Matsumura Oil Co., Ltd.); octane denotes n-octane; and EtOH denotes ethanol.

Comparative Example 12

20.0 parts of MA285 (Mitsubishi Chemical Corporation), 8.0 parts of a pigment dispersing agent, and 72.0 parts of tetrahydrofuran (THF) were mixed and then kneaded for 15 minutes using a paint shaker and steel beads having a diameter of 5 mm. This was followed by kneading for an additional 2 hours using an Eiger Motor Mill M-250 (Eiger Japan Co., Ltd.) and zirconia beads having a diameter of 0.05 mm.

To 17.5 parts of the resulting kneaded material were added 21 parts of Vylon 220 (Toyobo Co., Ltd.), 3.5 parts of FC1565 (Mitsubishi Rayon Co., Ltd.), and 58 parts of THF and stirring was carried out with heating at 50° C. This was followed by the addition with stirring of 1.0 parts of the toner particle dispersing agent Ajisper PB817 (Ajinomoto Fine-Techno Co., Inc.), and a mixture was then prepared by stirring while diluting with 69.6 parts of Moresco White P-40 (Matsumura Petrochemical Laboratories Co., Ltd.).

Then, using a unit in which a solvent distillation apparatus (connected to a pressure-reduction unit) was connected to a homogenizer provided with a sealed stirred tank, the mixture was stirred at high speed (5,000 rpm) by the homogenizer and, while this was done, the pressure was reduced by the pressure-reduction unit so as to provide a mixture temperature of 50° C. The THF was completely distilled off from the sealed stirred tank to provide the liquid developer of Comparative Example 12.

Comparative Example 13

Comparative Example Resin PESB-104 Production Example

A polyester resin having the monomer mass proportions given in Table 7 was synthesized by a known method.

TABLE 7

| | TPA | SIPA | NPG | PG | DPG | Mn | Acid value [mgKOH/g] |
|---|---|---|---|---|---|---|---|
| PESB-104 | 43 | 1 | 4 | 36 | 8 | 1,400 | 0.5 |

The following abbreviations are used in Table 7 and 8.
TPA: terephthalic acid
SIPA: monosodium 5-sulfoisophthalate
NPG: neopentyl glycol
PG: propylene glycol
DPG: dipropylene glycol
BPA-EO: 2 mol ethylene oxide adduct on bisphenol A
EG: ethylene glycol
IPA: isophthalic acid
TMA: trimellitic anhydride A urethane-modified polyester (PESB-104) was obtained by dissolving 100 parts of the resulting polyester resin in 300 parts of tetrahydrofuran, adding 10 parts of diphenylmethane diisocyanate, and reacting for 5 hours at 90° C. The property values of PESB-104 were a number-average molecular weight of 20,500 and an acid value of 0.9 mg KOH/g.

Comparative Example Resin PESA-105 Production Example

Polyester resin PESA-105, having the monomer molar proportions—as measured by NMR—given in Table 8, was synthesized by a known method.

TABLE 8

| | BPA-EO | EG | NPG | TPA | IPA | TMA | Position of trimellitic anhydride | Mn | n | SP value | Acid value |
|---|---|---|---|---|---|---|---|---|---|---|---|
| PESA-105 | 10 | 0 | 0 | 9 | 0 | 1 | In main chain | 2,420 | 9.3 | 11.5 | 20 |

Liquid Developer Production Example

A kneaded material was obtained by mixing 30 parts of Pigment Blue 15:3, 15 parts of a 32% tetrahydrofuran solution of the urethane-modified polyester PESB-104, 15 parts of Ajisper PB-821 (Ajinomoto Fine-Techno Co., Inc.), 255 parts of tetrahydrofuran, and 130 parts of glass beads (1 mm Ø); carrying out dispersion for 3 hours using an attritor (Nippon Coke & Engineering Co., Ltd.); and filtration across a mesh.

18 parts of the obtained kneaded material, 12.6 parts of a 50% tetrahydrofuran solution of polyester PESA-105, and 2.1 parts of a toner particle dispersing agent (Ajisper PB-817, Ajinomoto Fine-Techno Co., Inc.) were mixed using a high-speed disperser (T. K. Robomix/T. K. Homodisper Model 2.5 blade, PRIMIX Corporation) and were mixed while stirring at 40° C. to obtain a colorant dispersion.

A mixture was obtained by adding 200 parts of Moresco White MT-30P (Matsumura Oil Co., Ltd.) in small portions to 100 parts of the obtained colorant dispersion while stirring at high speed (25,000 rpm) using a homogenizer (Ultra-Turrax T50, IKA).

The resulting mixture was transferred to a recovery flask and the tetrahydrofuran was completely distilled off at 50° C. while applying ultrasound dispersion to obtain a toner particle dispersion in which toner particles were dispersed in an insulating liquid carrier.

Liquid Developer Preparation Step 10 parts of the resulting toner particle dispersion was subjected to a centrifugal separation treatment and the supernatant was removed by decantation. Fresh Moresco White MT-30P was then added in the same mass as the supernatant that had been removed and the toner particle dispersion was redispersed. 0.10 parts of Lecinol S-10 (hydrogenated lecithin, Nikko Chemicals Co., Ltd.) was added to the resulting dispersion to yield the liquid developer of Comparative Example 13.

Measurement and Evaluation of Toner Particle Dispersion Stability

Figure 2:
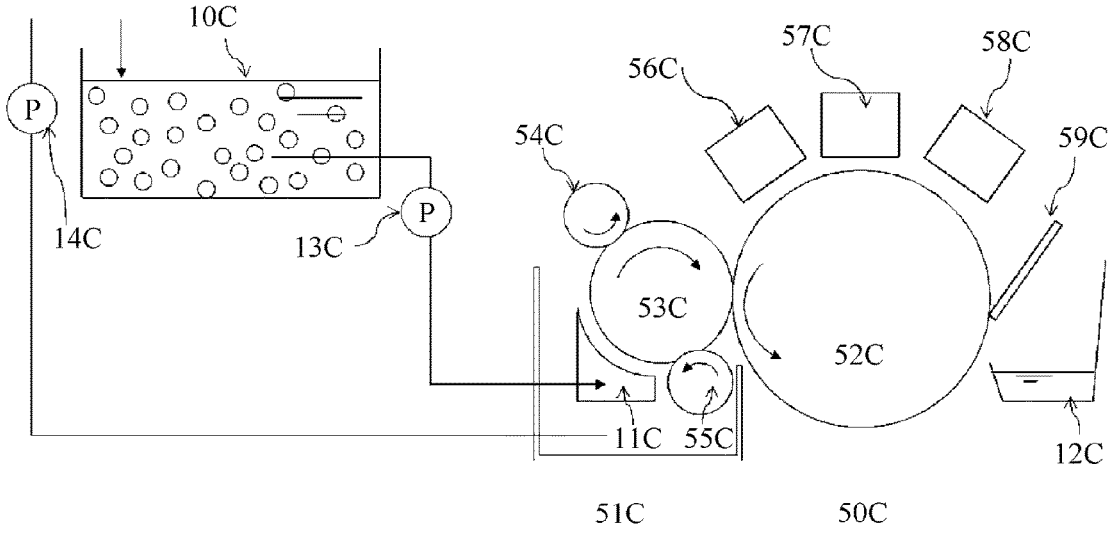
FIG. 2 is a schematic diagram of a developing apparatus.

Immediately after the production of the resulting liquid developer, a 2-hour continuous print run was carried out using the image-forming apparatus shown in FIG. 1 and FIG. 2 (14,400 prints at 120 prints/minute of A4 size of the N7 natural image of "High-Definition Color Digital Standard Images (XYZ/SCID)" of JIS X 9204:2004). After the 2-hour continuous print run, the 50% particle diameter on a volume basis (D50) of the toner particle was measured using a laser diffraction/scattering particle size distribution analyzer (product name: "LA-950", Horiba, Ltd.). The ratio $D50_{2h}/D50_{0h}$ was determined. The evaluation was performed based on this particle diameter increase ratio.

A $D50_{2h}/D50_{0h}$ ratio of not greater than 2 was regarded as excellent.

The reference signs in the figures are as follows.

10C, 10M, 10Y, 10K: developer container; 11C: film-production counterelectrode; 12C: recovery unit; 13C, 13M, 13Y, 13K: development liquid supply pump; 14C: development liquid recovery pump; 20: pre-wet roller; 21: pre-wet counter roller; 30: secondary transfer unit; 31: secondary transfer roller; 40: intermediate transfer belt; 41: belt driving roller; 42: driven roller; 50C, 50M, 50Y, 50K: image-forming unit; 51C, 51M, 51Y, 51K: developing unit; 52C, 52M, 52Y, 52K: photosensitive member; 53C: development roller; 54C: concentration roller; 55C: cleaning roller; 56C: photoexposure unit; 57C: charging unit; 58C: static-eliminating unit; 59C: recovery blade; 60C, 60M, 60Y, 60K: primary transfer unit; 61C, 61M, 61Y, 61K: primary transfer roller; 80: recording medium; 90: developer curing unit The results of the evaluations for Examples 1 to 14 and Comparative Examples 1 to 13 are given in Table 9.

TABLE 9

| | SP value | | | | Evaluation | | |
|---|---|---|---|---|---|---|---|
| Example No. | Liquid a | Toner particle dispersing agent | Second term in formula (7) | Polyester resin B | Initial D50 [nm] | D50 after durability test [nm] | $D50_{2h}/D50_{0h}$ |
| 1 | 7.9 | 10.9 | 11.2 | 12.0 | 605 | 702 | 1.2 |
| 2 | 7.9 | 10.9 | 11.2 | 12.0 | 604 | 664 | 1.1 |
| 3 | 7.6 | 10.9 | 11.2 | 12.0 | 605 | 796 | 1.3 |
| 4 | 7.6 | 10.9 | 11.2 | 12.0 | 599 | 802 | 1.3 |
| 5 | 7.6 | 10.9 | 11.2 | 12.0 | 596 | 849 | 1.4 |
| 6 | 7.6 | 10.6 | 10.9 | 12.0 | 604 | 896 | 1.5 |
| 7 | 7.6 | 10.6 | 10.9 | 12.0 | 594 | 951 | 1.6 |
| 8 | 7.6 | 10.6 | 10.9 | 12.0 | 607 | 1004 | 1.7 |
| 9 | 7.6 | 10.6 | 10.7 | 12.0 | 596 | 1050 | 1.8 |
| 10 | 7.6 | 10.6 | 10.7 | 12.0 | 597 | 1104 | 1.9 |
| 11 | 7.6 | 10.6 | 11.7 | 11.4 | 603 | 1203 | 2.0 |
| 12 | 7.6 | 10.6 | 11.7 | 11.4 | 595 | 1203 | 2.0 |
| 13 | 7.6 | 10.6 | 11.7 | 11.4 | 600 | 1198 | 2.0 |
| 14 | 7.6 | 10.6 | 11.7 | 11.4 | 607 | 1198 | 2.0 |
| C.E. 1 | 7.6 | 10.6 | 11.3 | 11.4 | 1512 | 5593 | 3.7 |
| C.E. 2 | 7.6 | 10.6 | 10.5 | 11.4 | 604 | 2194 | 3.6 |
| C.E. 3 | 7.6 | 10.6 | 10.9 | 11.4 | 597 | 2192 | 3.7 |
| C.E. 4 | 7.6 | 10.6 | 10.9 | 11.4 | 596 | 2191 | 3.7 |
| C.E. 5 | 7.6 | 10.6 | 11.7 | 12.0 | 1295 | 4791 | 3.7 |
| C.E. 6 | 7.6 | 10.6 | 11.7 | 12.0 | 599 | 2186 | 3.7 |
| C.E. 7 | 7.6 | 10.6 | 11.7 | 12.0 | 593 | 2191 | 3.7 |
| C.E. 8 | 7.6 | 10.2 | 11.2 | 11.4 | 597 | 2213 | 3.7 |
| C.E. 9 | 7.6 | 10.6 | 11.7 | 11.4 | 606 | 2178 | 3.6 |
| C.E. 10 | 7.6 | 10.6 | 11.7 | 11.4 | 606 | 2207 | 3.6 |
| C.E. 11 | 14 | 10.6 | 11.7 | 11.4 | 2156 | 5999 | 2.8 |
| C.E. 12 | | Not determined | | 12.0 | 708 | 3098 | 4.4 |
| C.E. 13 | 7.3 | Not determined | | 11.7 | 701 | 3099 | 4.4 |

In Table 9, C. E. denotes Comparative Example.

The results for Examples 9 and 10 and Comparative Example 2 demonstrate that, when the number-average molecular weight of the polyester resin A is at least 3,000, after the durability test the particle diameter is not greater than 2 μm and the particle diameter ratio is not greater than 2.0-fold and aggregation is thus inhibited.

The results for Example 11 and Comparative Example 1 demonstrate that, when the number-average molecular weight of the polyester resin A is not more than 7,000, after the durability test the particle diameter is not greater than 2 μm and the particle diameter ratio is not greater than 2.0-fold and aggregation is thus inhibited.

The results for Example 12 and Comparative Example 3 demonstrate that, when the acid value of the polyester resin A is at least 5 mg KOH/g, after the durability test the particle diameter is not greater than 2 μm and the particle diameter ratio is not greater than 2.0-fold and aggregation is thus inhibited.

The results for Example 11 and Comparative Example 4 demonstrate that, when the polyester resin A contains a carboxy group deriving from trimellitic acid or trimellitic anhydride as an acidic group, after the durability test the particle diameter is not greater than 2 μm and the particle diameter ratio is not greater than 2.0-fold and aggregation is thus inhibited.

The results for Example 10 and Comparative Example 6 demonstrate that, when the number-average molecular weight of the polyester resin B is at least 4,000, after the durability test the particle diameter is not greater than 2 μm and the particle diameter ratio is not greater than 2.0-fold and aggregation is thus inhibited.

The results for Example 13 and Comparative Example 5 demonstrate that, when the number-average molecular weight of the polyester resin B is not more than 20,000, after the durability test the particle diameter is not greater than 2 μm and the particle diameter ratio is not greater than 2.0-fold and aggregation is thus inhibited.

The results for Example 10 and Comparative Example 7 demonstrate that, when the acid value of the polyester resin B is not more than 2 mg KOH/g, after the durability test the particle diameter is not greater than 2 μm and the particle diameter ratio is not greater than 2.0-fold and aggregation is thus inhibited.

The results for Example 11 and Comparative Example 8 demonstrate that, when the amine value of the toner particle dispersing agent is at least 40 mg KOH/g, after the durability test the particle diameter is not greater than 2 μm and the particle diameter ratio is not greater than 2.0-fold and aggregation is thus inhibited.

The results for Examples 11 and 14 and Comparative Examples 9 and 10 demonstrate that, when the B/(A+B) mass ratio for the polyester resin A and the polyester resin B is from 0.3 to 0.9, after the durability test the particle diameter is not greater than 2 μm and the particle diameter ratio is not greater than 2.0-fold and aggregation is thus inhibited.

The results for Example 11 and Comparative Example 11 demonstrate that, when the relationship: SP value of liquid a<SP value of the toner particle dispersing agent<SP value of polyester resin B is satisfied, after the durability test the particle diameter is not greater than 2 μm and the particle diameter ratio is not greater than 2.0-fold and aggregation is thus inhibited.

A comparison of Example 11 with Example 10 demonstrates that, when the SP value of the polyester resin B and the SP value of the liquid a satisfy formula (7), the particle diameter ratio after the durability test goes from 2.0-fold to 1.9-fold and the aggregation-inhibiting effect is thus further increased.

A comparison of Example 9 with Example 10 demonstrates that, when the number-average molecular weight of the polyester resin B is made at least 7,000, the particle diameter ratio after the durability test goes from 1.9-fold to 1.8-fold and the aggregation-inhibiting effect is thus further increased.

A comparison of Example 8 with Example 9 demonstrates that, when the number-average molecular weight of the polyester resin A is made at least 4,000, the particle diameter ratio after the durability test goes from 1.8-fold to 1.7-fold and the aggregation-inhibiting effect is thus further increased.

A comparison of Example 7 with Example 8 demonstrates that, when the polyester resin B has a sulfo group that has formed a salt with at least one element selected from the alkali metals and alkaline-earth metals, the particle diameter ratio after the durability test goes from 1.7-fold to 1.6-fold and the aggregation-inhibiting effect is thus further increased.

A comparison of Example 6 with Example 7 demonstrates that, when the acidic group of the polyester resin A is present in terminal position on the polyester resin A, the particle diameter ratio after the durability test goes from 1.6-fold to 1.5-fold and the aggregation-inhibiting effect is thus further increased.

A comparison of Example 5 with Example 6 demonstrates that, when the amine value of the toner particle dispersing agent is at least 60 mg KOH/g, the particle diameter ratio after the durability test goes from 1.5-fold to 1.4-fold and the aggregation-inhibiting effect is thus further increased.

A comparison among Example 3, Example 4, and Example 5 demonstrates that, when the B/(A+B) mass ratio for the polyester resin A and the polyester resin B is from 0.4 to 0.8, the particle diameter ratio after the durability test goes from 1.4-fold to 1.3-fold and the aggregation-inhibiting effect is thus further increased.

A comparison of Example 1 with Example 3 demonstrates that, when an insulating liquid carrier is used as the liquid a, the particle diameter ratio after the durability test goes from 1.3-fold to 1.2-fold and the aggregation-inhibiting effect is thus further increased.

The results for Example 1 and Example 2 demonstrate that the particle diameter ratio after the durability test is brought to 1.1-fold—and the aggregation-inhibiting effect is thus further increased—through production of the toner particle by the so-called coacervation method.

The results for Comparative Example 12 demonstrated that the effects of the present invention are not obtained with the method described in the examples of Japanese Patent Application Laid-open No. 2014-232211, which is a method that does not satisfy claim 1 of the present invention.

The results for Comparative Example 13 demonstrated that the effects of the present invention are not obtained with the method described in the examples of Japanese Patent Application Laid-open No. 2016-224405, which is a method that does not satisfy claim 1 of the present invention.

Example 15

Cationically Polymerizable, Ultraviolet-Curable Liquid Developer Production Example Liquid Developer Production Example Using Coacervation Method Pigment Dispersion Production Step Pigment Dispersion Production Example Pigment Blue 15:3 (30 parts), Vylon UR4800 (47 parts), 255 parts of tetrahydrofuran, and 130 parts of glass beads (1 mm Ø) were mixed; dispersion was performed for 3 hours using an attritor [Nippon Coke & Engineering Co., Ltd.]; and filtration across a mesh was carried out to obtain a kneaded material.

180 parts of the obtained kneaded material, 69 parts of a 50% tetrahydrofuran solution of polyester resin A (PESA-1), 46 parts of a 50% tetrahydrofuran solution of polyester resin B (PESB-1), and 2.7 parts of the toner particle dispersing agent Dis-1 were mixed using a high-speed disperser (T. K. Robomix/T. K. Homodisper Model 2.5 blade, PRIMIX Corporation) and were mixed while stirring at 40° C. to obtain a pigment dispersion.

Mixture Production Example

A mixture was obtained by adding 70 parts of dodecyl vinyl ether as liquid a in small portions to 100 parts of the obtained pigment dispersion while stirring at high speed (25,000 rpm) using a homogenizer (Ultra-Turrax T50, IKA).

Distillative Removal Step

The resulting mixture was transferred to a recovery flask and the tetrahydrofuran was completely distilled off at 50° C. while performing ultrasound dispersion to obtain a toner particle dispersion T-15.

Liquid Developer Preparation Step

The following were mixed into 10 parts of the resulting toner particle dispersion T-15 to obtain a cationically polymerizable, ultraviolet-curable liquid developer: 0.10 parts of hydrogenated lecithin (Lecinol S-10, Nikko Chemicals Co., Ltd.) as charge control agent, 80.00 parts of butylethylpropanediol divinyl ether (BEPDVE) as cationically polymerizable liquid monomer, the previously listed compound A-26 (0.30 parts) as polymerization initiator, 0.50 parts of 2,4-diethylthioxanthone as sensitizer, and 0.50 parts 1,4-diethoxynaphthalene as co-sensitizer.

Example 16

Cationically Polymerizable, Ultraviolet-Curable Liquid Developer Production Example After a coarsely pulverized toner particle had been obtained proceeding as in Example 1, a toner particle dispersion T-16 was obtained by the same method as in Example 1, but using dodecyl vinyl ether (SP value=8.1) as the liquid a in place of the MT-30P.

Using the obtained toner particle dispersion T-16, a cationically polymerizable, ultraviolet-curable liquid developer was then obtained using the same method as in the Liquid Developer Preparation Step of Example 15.

Example 17

(Cationically Polymerizable, Ultraviolet-Curable Liquid Developer Production Example)

A cationically polymerizable, ultraviolet-curable liquid developer was obtained using the same method as in Example 16, but, as shown in Table 10, changing the liquid a to oxetane.

TABLE 10

| Liquid developer | Polyester resin A | Polyester resin B | Toner particle dispersing agent | B/(A + B) | Production Procedure | Production Liquid a | Insulating liquid carrier |
|---|---|---|---|---|---|---|---|
| Example 15 | PESA-1 | PESB-1 | Dis-1 | 0.4 | CO | DDVE | UL |
| Example 16 | PESA-1 | PESB-1 | Dis-1 | 0.4 | WP | DDVE | UL |
| Example 17 | PESA-1 | PESB-1 | Dis-1 | 0.4 | WP | OXT-221 | UL |

In Table 10, WP denotes Wet pulverization; CO denotes Coacervation; UL denotes Ultraviolet-Curable Liquid; DDVE denotes dodecyl vinyl ether (SP value=8.13); and OXT-221 denotes oxetane (SP value=8.8, Toagosei Co., Ltd.).

Measurement and Evaluation of Toner Particle Dispersion Stability

Using the same method as for Examples 1 to 13 and Comparative Examples 1 to 13, the value of the 50% particle diameter on a volume basis (D50) was evaluated immediately after production of the liquid developer and after the two-hour durability test and the ratio between these values was evaluated.

Evaluation of Fixing Performance of Cationically Polymerizable, Ultraviolet-Curable Liquid Developers Operating in an environment at room temperature (25° C.) and a humidity of 50%, the ultraviolet-curable liquid developer was dripped onto a polyethylene terephthalate film (Teijin Limited, Panlite : PC-2151, thickness=0.3 mm); bar coating was carried out using a wire bar (No. 6) [supplier: Matsuo Sangyo Co., Ltd.] (the resulting film had a thickness of 8.0 μm); and a cured film was formed by irradiating light at a wavelength of 365 nm from a high-pressure mercury lamp having a lamp output of 120 mW/cm$^2$. The irradiated light dose was measured at the point at which surface tack (stickiness) was absent and complete curing had occurred. The evaluation was performed using the following criteria.

5: 100 mJ/cm$^2$
4: 200 mJ/cm$^2$
3: 400 mJ/cm$^2$
2: 1,000 mJ/cm$^2$
1: not cured at 2,000 mJ/cm$^2$ All of the fixing performance ranks equal to or greater than 3 were regarded as passing.

The results of the evaluations for Examples 15 to 17 are given in Table 11.

The results for Example 17 demonstrate that, when a cationically polymerizable liquid monomer, such as a vinyl ether compound, was used for the insulating liquid carrier, a liquid developer having an excellent curability was obtained and the particle diameter ratio after durability testing was brought to 1.1-fold, thus further increasing the aggregation-inhibiting effect.

A comparison of Example 16 with Example 17 demonstrates that, when a vinyl ether compound and a compound with formula (8) are incorporated, a liquid developer with an excellent curability is obtained, which cures at an even lower energy, and in combination with this the particle diameter ratio after durability testing is brought to 1.1-fold, thus further increasing the aggregation-inhibiting effect.

A comparison of Example 15 with Example 16 shows that, by producing the toner particle by a so-called coacervation method, a liquid developer with an excellent curability is obtained, which cures at low energy, and in combination with this the particle diameter ratio after durability testing is brought to 1.0-fold, thus further increasing the aggregation-inhibiting effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-222664, filed Nov. 20, 2017, and Japanese Patent Application No. 2018-129132, filed Jul. 6, 2018, which are hereby incorporated by reference herein in their entirety.

What is claimed is:

1. A method for producing a liquid developer containing an insulating liquid carrier, a toner particle dispersing agent, and a toner particle that contains a polyester resin A and a polyester resin B, the method comprising the following process A or process B:

the process A having a step of particulating a mixture of the polyester resin A, the polyester resin B, and the toner particle dispersing agent in a liquid a by applying a shear force to the mixture, and

TABLE 11

| Liquid developer | SP value: Liquid a | SP value: Toner particle dispersing agent | SP value: Second term in formula (7) | SP value: Polyester resin B | Evaluation: Initial D50[nm] | Evaluation: D50 after durability test[nm] | Evaluation: $D50_{2h}/D50_{0h}$ | Evaluation: Evaluation of curability |
|---|---|---|---|---|---|---|---|---|
| Example 15 | 8.1 | 10.9 | 11.2 | 12.0 | 498 | 500 | 1.0 | 5 |
| Example 16 | 8.1 | 10.9 | 11.2 | 12.0 | 595 | 650 | 1.1 | 5 |
| Example 17 | 8.8 | 10.9 | 11.2 | 12.0 | 606 | 697 | 1.1 | 3 |

a step of producing a toner particle in the liquid a via a molten state; and the process B having a step of dissolving, in a solvent b, a mixture of the polyester resin A, the polyester resin B, and the toner particle dispersing agent, a step of mixing the resulting solution with the liquid a and applying a shear force to particulate the mixture in the liquid a and provide a toner particle, and a step of distillatively removing the solvent b, wherein the liquid a dissolves the toner particle dispersing agent and does not dissolve the polyester resin A and does not dissolve the polyester resin B, the polyester resin A has a number-average molecular weight from 3,000 to 7,000, the polyester resin A has an acid value of at least 5 mg KOH/g, the polyester resin A has, as an acidic group, a carboxy group deriving from trimellitic acid and/or trimellitic anhydride, the polyester resin B has a number-average molecular weight from 4,000 to 20,000, the polyester resin B has an acid value of not more than 2 mg KOH/g, the toner particle dispersing agent has a primary amino group, the toner particle dispersing agent has an amine value of at least 40 mg KOH/g, a mass ratio (B/(A+B)) of the polyester resin B to a sum of the polyester resin A and the polyester resin B is from 0.3 to 0.9, and an SP value of the liquid a, an SP value of the polyester resin B, and an SP value of the toner particle dispersing agent satisfy the following relationship: SP value of liquid a<SP value of toner particle dispersing agent<SP value of polyester resin B.

2. The method for producing a liquid developer according to claim 1, wherein the SP value of the polyester resin B and the SP value of the liquid a satisfy the following formula (7):

$$SP_{career} < \left(\frac{E_d + a \times n \times E_p}{(V_d + a \times n \times V_p)}\right)^{0.5} < SP_{PESB} \quad (7)$$

in formula (7), Ed and Ep respectively represent cohesive energy of the toner particle dispersing agent and the polyester resin A; Vd and Vp respectively represent a molar volume of the toner particle dispersing agent and the polyester resin A; a represents a number-average number of amino groups per molecule with respect to an average degree of polymerization of the toner particle dispersing agent; n represents a number-average degree of polymerization of the polyester resin A; $SP_{Career}$ represents the SP value of the liquid a; and $SP_{PESB}$ represents the SP value of the polyester resin B.

3. The method for producing a liquid developer according to claim 1, wherein the polyester resin B has a number-average molecular weight from 7,000 to 20,000.

4. The method for producing a liquid developer according to claim 1, wherein the polyester resin A has a number-average molecular weight from 4,000 to 7,000.

5. The method for producing a liquid developer according to claim 1, wherein the polyester resin B has a sulfo group that has formed a salt with at least one element selected from the group consisting of alkali metals and alkaline-earth metals.

6. The method for producing a liquid developer according to claim 1, wherein the carboxy group is present in terminal position on the polyester resin A.

7. The method for producing a liquid developer according to claim 1, wherein the toner particle dispersing agent has an amine value of at least 60 mg KOH/g.

8. The method for producing a liquid developer according to claim 1, wherein the mass ratio (B/(A+B)) of the polyester resin B to the sum of the polyester resin A and the polyester resin B is from 0.4 to 0.8.

9. The method for producing a liquid developer according to claim 1, wherein the liquid a is an insulating liquid carrier.

10. The method for producing a liquid developer according to claim 1, wherein the insulating liquid carrier contains a cationically polymerizable liquid monomer.

11. The method for producing a liquid developer according to claim 10, wherein the cationically polymerizable liquid monomer is a vinyl ether compound and the liquid developer contains a compound represented by the following formula (8):

(8)

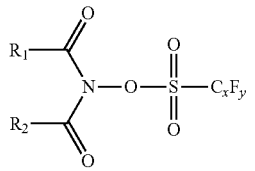

in formula (8), $R_1$ and $R_2$ are bonded to each other to form a cyclic structure; x represents an integer from 1 to 8; and y represents an integer from 3 to 17.

* * * * *